US008824919B2

(12) United States Patent
Kikuchi

(10) Patent No.: US 8,824,919 B2
(45) Date of Patent: Sep. 2, 2014

(54) ELECTROPHOTOGRAPHIC IMAGE FORMING APPARATUS HAVING ROTATION-REGULATED PROCESS CARTRIDGE

(75) Inventor: Ken Kikuchi, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 141 days.

(21) Appl. No.: 13/309,808

(22) Filed: Dec. 2, 2011

(65) Prior Publication Data

US 2012/0195627 A1 Aug. 2, 2012

(30) Foreign Application Priority Data

Dec. 16, 2010 (JP) ..... 2010-281048
Oct. 28, 2011 (JP) ..... 2011-237521

(51) Int. Cl.
*G03G 15/00* (2006.01)
*G03G 21/16* (2006.01)
*G03G 21/18* (2006.01)

(52) U.S. Cl.
USPC ..... 399/110; 399/111; 399/113

(58) Field of Classification Search
USPC ..... 399/110, 111, 113
See application file for complete search history.

(56) References Cited

U.S. PATENT DOCUMENTS 6,708,011 B2 * 3/2004 Nomura et al. ..... 399/110
7,127,194 B2 10/2006 Hoshi et al.
7,349,649 B2 3/2008 Hoshi et al.
7,890,012 B2 2/2011 Koishi et al.
8,027,614 B2 9/2011 Igarashi
8,041,286 B2 10/2011 Won
8,165,493 B2 4/2012 Chadani et al.
8,213,831 B2 * 7/2012 Toba et al. ..... 399/111
8,369,743 B2 * 2/2013 Maeshima et al. ..... 399/111
8,452,208 B2 5/2013 Kikuchi
8,526,841 B2 9/2013 Koishi et al.
2007/0160385 A1 * 7/2007 Noguchi et al. ..... 399/110

(Continued)

FOREIGN PATENT DOCUMENTS

CN 101196710 A 6/2008
CN 101592912 A 12/2009

(Continued)

OTHER PUBLICATIONS

JPO Notification of Reasons for Refusal in Japanese Appl. 2011-237521 dated Dec. 14, 2012.*

(Continued)

*Primary Examiner* — David Bolduc
(74) *Attorney, Agent, or Firm* — Fitzpatrick, Cella, Harper & Scinto

(57) ABSTRACT

An electrophotographic image forming apparatus for forming an image on a recording material includes a detachably-mounted cartridge including an electrophotographic photosensitive member, first and second portions-to-be-regulated for regulating rotation of the cartridge when a driving force receiving portion receives a driving force, and a transfer member for transferring a developer image formed on the electrophotographic photosensitive member onto a toner image receiving member. A supporting member is movable between an inside position which is in a main assembly of the apparatus and an outer portion, and a contacting and spacing member is movable relative to the supporting member. In addition, a first regulating portion permits movement of the supporting member between the outer position and the inside position, and a second regulating portion regulates rotation of the cartridge.

5 Claims, 21 Drawing Sheets

(56) References Cited

U.S. PATENT DOCUMENTS

| | | | | |
|---|---|---|---|---|
| 2008/0159772 | A1* | 7/2008 | Koishi et al. | 399/90 |
| 2008/0159773 | A1* | 7/2008 | Murayama et al. | 399/90 |
| 2008/0159775 | A1* | 7/2008 | Koishi et al. | 399/90 |
| 2008/0292355 | A1* | 11/2008 | Sakurai et al. | 399/110 |
| 2009/0003875 | A1* | 1/2009 | Toba et al. | 399/111 |
| 2009/0047039 | A1* | 2/2009 | Noguchi et al. | 399/116 |
| 2009/0080934 | A1 | 3/2009 | Nakanishi et al. | |
| 2009/0092412 | A1* | 4/2009 | Kei | 399/110 |
| 2010/0074650 | A1* | 3/2010 | Kawai | 399/119 |
| 2010/0080615 | A1* | 4/2010 | Kikuchi | 399/111 |
| 2010/0080627 | A1* | 4/2010 | Takamura | 399/167 |
| 2010/0166462 | A1 | 7/2010 | Igarashi | |
| 2010/0202797 | A1 | 8/2010 | Kikuchi et al. | |
| 2010/0239308 | A1 | 9/2010 | Kikuchi et al. | |
| 2010/0239311 | A1 | 9/2010 | Kikuchi et al. | |
| 2010/0239312 | A1 | 9/2010 | Kikuchi et al. | |
| 2010/0239314 | A1 | 9/2010 | Takayama | |
| 2010/0247138 | A1 | 9/2010 | Kikuchi et al. | |
| 2010/0247140 | A1 | 9/2010 | Kikuchi et al. | |
| 2010/0247142 | A1 | 9/2010 | Kikuchi et al. | |
| 2011/0116832 | A1* | 5/2011 | Koishi et al. | 399/111 |
| 2011/0123223 | A1* | 5/2011 | Koishi et al. | 399/111 |
| 2011/0305479 | A1 | 12/2011 | Nishiuwatoko et al. | |
| 2012/0141165 | A1* | 6/2012 | Sakurai et al. | 399/119 |
| 2012/0308264 | A1 | 12/2012 | Kikuchi | |

FOREIGN PATENT DOCUMENTS

| | | | |
|---|---|---|---|
| CN | 101639660 | A | 2/2010 |
| JP | 2008-165023 | A | 7/2008 |
| JP | 2009-031770 | A | 2/2009 |
| JP | 2010-011559 | A | 1/2010 |
| JP | 2010-102304 | A | 5/2010 |
| JP | 2010-181832 | A | 8/2010 |

OTHER PUBLICATIONS

Japanese Office Action dated Dec. 18, 2012, in related Japanese Patent Application No. 2011-237521 (with English translation).

Chinese Office Action dated Mar. 14, 2014, in related Chinese Patent Application No. 201110424203.X (with English translation).

* cited by examiner (a)

(b)

(a)

(b)

ELECTROPHOTOGRAPHIC IMAGE FORMING APPARATUS HAVING ROTATION-REGULATED PROCESS CARTRIDGE

FIELD OF THE INVENTION AND RELATED ART

The present invention relates to an electrophotographic image forming apparatus.

Heretofore, in the field of an image forming apparatus which uses an electrophotographic image forming process, the process cartridge which includes a photosensitive drum and a developing roller which acts on the photosensitive drum and a developing unit which contains a developer (toner) to be used for the image formation as a unit is known. A developing cartridge type using the developing unit which does not include the photosensitive drum is also known. According to these cartridge types, a maintenance operation of a device can be carried out by the user without a service person, in effect. For this reason, these cartridge types are widely used for the electrophotographic image forming apparatus.

It is also known that a supporting member for carrying the process cartridge or the developing cartridge is provided, and the exchange of the cartridge is capable by drawing this supporting member from the inside of the main assembly to a predetermined position. According to this technique, the user can supply the developer easily, in effect.

In such a type which uses the supporting member, it is preferable that a surface of the photosensitive drum in the supporting member does not contact to the surface of a transfer member and so on during the mounting operation into the main assembly of apparatus.

In view of this, a spacer member for spacing the transfer member surface from the surface of the photosensitive drum is provided in the supporting member, and the photosensitive drum is spaced from the transfer member during the mounting operation. It is known that after completion of the mounting, the spacing action of the spacer member is stopped, by which the photosensitive drum and the transfer member are contacted to each other (Japanese Laid-open Patent Application 2010-181832).

SUMMARY OF THE INVENTION

However, in such a conventional example, the position of the photosensitive drum in the supporting member during the mounting operation of a supporting member into the main assembly of the device, is not particularly limited or regulated. Therefore, the gap between the surface of the photosensitive drum and the transfer member is unstable. For this reason, in the conventional structure, the gap therebetween is made large in the design so as to assure the spacing between the surface of the photosensitive drum and the transfer member surface. This is against the downsizing of the main assembly of the device.

Accordingly, it is an object of the present invention to provide an electrophotographic image forming apparatus in which a supporting member supporting a photosensitive drum is mounted to a main assembly of the apparatus, and which is downsized without sliding between the photosensitive drum and a transfer member.

According to an aspect of the present invention, there is provided an electrophotographic image forming apparatus for forming an image on a recording material, said apparatus comprising (i) a cartridge detachably mountable to a main assembly of the apparatus, said cartridge including an electrophotographic photosensitive member, a photosensitive member frame supporting said electrophotographic photosensitive member, a driving force receiving portion for receiving a driving force for driving said electrophotographic photosensitive member from said main assembly of the apparatus, and a portion-to-be-regulated, provided on said photosensitive member frame, for regulating rotation of said cartridge when said driving force receiving portion receives the driving force; (ii) a transfer member for transferring a developer image formed on said electrophotographic photosensitive member onto a toner image receiving member; (iii) a supporting member movable between an inside position which is in said main assembly of the apparatus and in which said supporting member detachably supports said cartridge and an outer position which is outside said main assembly of the apparatus and in which said cartridge is mountable and demountable; (iv) a contacting and spacing member movable relative to said supporting member and capable of taking a first position in which said contacting and spacing member urges said portion-to-be-regulated to space said electrophotographic photosensitive member from said transfer member and a second position in which said contacting and spacing member retracts from the first position to contact said electrophotographic photosensitive member to said transfer member; and (v) a regulating portion for engaging with said portion-to-be-regulated to regulate rotation of said cartridge when said contacting and spacing member is in the second position and said driving force receiving portion receives the driving force, and for permitting, when said contacting and spacing member is in the first position, movement of said supporting member between the outer position and the inside position in a state that said regulating portion is in engagement with said portion-to-be-regulated to limit rotation of said cartridge.

According to another aspect of the present invention, there is provided an electrophotographic image forming apparatus for forming an image on a recording material, said apparatus comprising (i) a cartridge detachably mountable to a main assembly of the apparatus, said cartridge including an electrophotographic photosensitive member, a photosensitive member frame supporting said electrophotographic photosensitive member, a driving force receiving portion for receiving a driving force for driving said electrophotographic photosensitive member from said main assembly of the apparatus, and first and second portions-to-be-regulated for regulating rotation of said cartridge when said driving force receiving portion receives the driving force, said second portion-to-be-regulated being, provided on said photosensitive member frame; (ii) a transfer member for transferring a developer image formed on said electrophotographic photosensitive member onto a toner image receiving member; (iii) a supporting member movable between an inside position which is in said main assembly of the apparatus and in which said supporting member detachably supports said cartridge and an outer position which is outside said main assembly of the apparatus and in which said cartridge is mountable and demountable; (iv) a contacting and spacing member movable relative to said supporting member and capable of taking a first position in which said contacting and spacing member urges said second portion-to-be-regulated to space said electrophotographic photosensitive member from said transfer member and a second position in which said contacting and spacing member retracts from the first position to contact said electrophotographic photosensitive member to said transfer member; (v) a first regulating portion for permitting, when said contacting and spacing member is in the first position, movement of said supporting member between the outer position and the inside position in a state that said regulating portion is in engagement with said portion-to-be-regulated to limit rotation of said cartridge; and (vi) a second regulating portion for regulating rotation of said cartridge when said contacting and spacing member is in the second position and said driving force receiving portion receives the driving force.

These and other objects, features, and advantages of the present invention will become more apparent upon consideration of the following description of the preferred embodiments of the present invention, taken in conjunction with the accompanying drawings.

DESCRIPTION OF THE PREFERRED EMBODIMENTS

Embodiment 1

A first embodiment of the present invention will be described.

<General Arrangement of Image Forming Apparatus>

Figure 1:
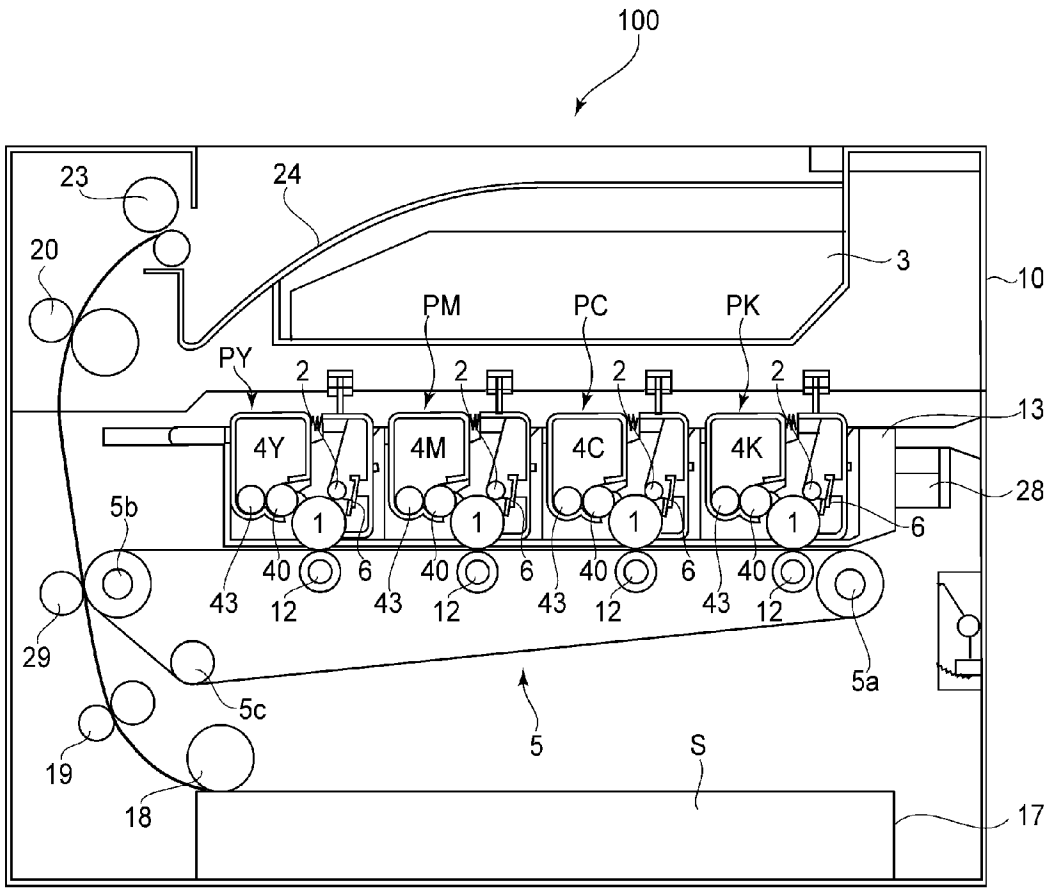
FIG. 1 is a sectional view illustrating a state of an image forming apparatus according to Embodiment 1 of the present invention during an image forming operation.
Figure 2:
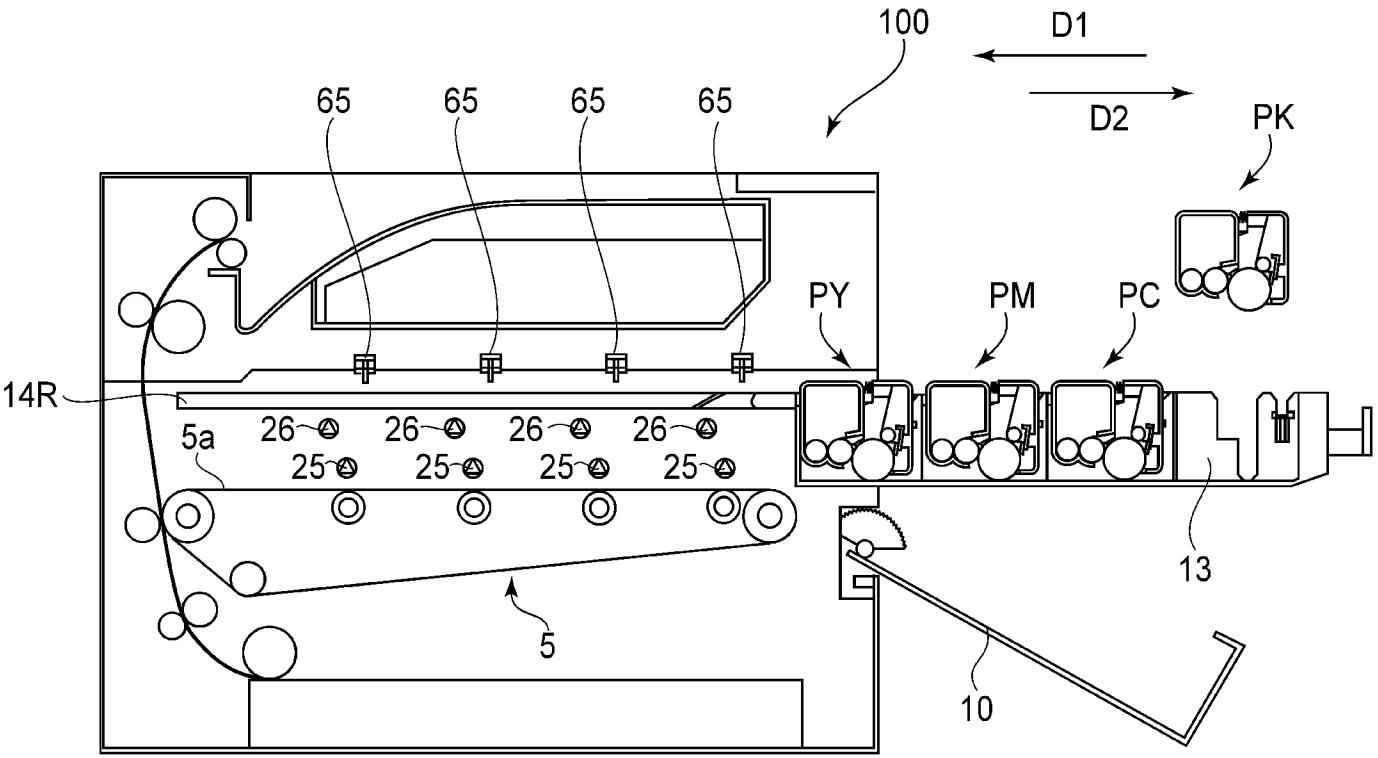
FIG. 2 is a sectional view illustrating mounting of a drawer member to a main assembly of the image forming apparatus in Embodiment 1.

Referring to FIGS. 1 and 2, the description will be made as to the general arrangement of the image forming apparatus according to Embodiment 1 of the present invention. FIG. 1 is a schematic sectional view of the image forming apparatus according to Embodiment 1 of the present invention. FIG. 2 is a schematic sectional view illustrating the state that the drawer unit in the image forming apparatus according to Embodiment 1 of the present invention is drawn.

In an image forming apparatus 100 according to this embodiment, the four electrophotographic photosensitive drums (photosensitive drums 1) juxtaposed horizontally is employed. The photosensitive drum 1 is rotated in the counterclockwise direction in FIG. 1 by unshown driving means.

The image forming apparatus 100 includes the charging means 2, a scanner unit 3, a development unit 4Y, 4M, 4C, 4K, and the electrostatic transfer means 5 and so on as electrophotographic image forming process means, in addition to the photosensitive drum 1. The developing units 4K, 4M, 4C, 4K maybe simply called developing unit 4 where doing so is clear, although y represents yellow; m represents magenta; c represents cyan; and k represents black.

Here, the charging means 2 has the function of charging a surface of the photosensitive drum 1 uniformly. The scanner unit 3 projects a laser beam onto the photosensitive drum 1 on the basis of image information to form an electrostatic latent image on the surface of the photosensitive drum 1. The developing unit 4 develops the electrostatic latent image formed on the surface of the photosensitive drum 1 using the toner which is a developer. The electrostatic transfer means (transfer member) 5 transfers a toner image on the photosensitive drum 1 onto a sheet material S as a recording material which is a transfer member. Specific examples of sheet material S include the paper, an OHP sheet, and cloth.

The image forming apparatus 100 includes cleaning means 6 for removing the toner which remains on the surface of the photosensitive drum after the transferring 1.

The photosensitive drum 1 includes an aluminum cylinder and an organic photoconductor layer (OPC photosensitive member) applied on an outer surface thereof, for example. The photosensitive drum 1 is supported by an unshown supporting member rotatably at the opposite ends thereof. One of the ends is provided with an unshown drum coupling for receiving a driving force from a driving motor (unshown). By this, the photosensitive drum 1 receives the driving force of the driving motor through the drum coupling to rotate clockwisely in FIG. 1.

The charging means 2 according to this embodiment is means of a contact charging type. More specifically, the charging means 2 is an electroconductive roller in the form of the charging roller and contacts to the surface of the photosensitive drum 1. A charging bias voltage is applied to this charging roller, by which the surface of the photosensitive drum 1 is charged uniformly.

The scanner unit 3 is disposed above the photosensitive drum 1. In the scanner unit 3, the image light (laser beam) corresponding to an image signal is emitted from an unshown laser diode and it is incident on the surface of the charged photosensitive drum 1. By this, the electrostatic latent image corresponding to the image signal is formed on the surface of the photosensitive drum 1.

The developing units 4 include the toner containers 41*y*, 41*m*, 41*c*, 41*k* which accommodates the yellow, the magenta, the cyan, and the black toner, respectively. The toner containers 41*y*, 41*m*, 41*c*, 41*k* are the developer accommodating portions which accommodate the developer (toner) to be supplied to the developing roller 40. The toner in the toner containers 41*y*, 41*m*, 41*c*, and 41*k* is fed to a toner supplying rollers 43. The toner is applied to the outer periphery of the developing roller 40, and the charge is applied to the toner, by the toner supplying roller 43 and a developing blade 44 press-contacted to an outer periphery of the developing roller 40.

By applying a developing bias to the developing roller 40, the toner is deposited on a latent image formed on the photosensitive drum 1 to form the toner image. The developing roller 40 is opposed and contacted to to the photosensitive drum 1. Here, the developing unit 4 and the photosensitive drum 1 form integral process cartridge P (PY, PM, PC, PK). In the process cartridge P, the toner is consumed with usage, and when the lifetime ends, the process cartridge P can be exchanged (so-called cartridge type).

The operation for forming a full-color image is as follows. The drum 1 of each cartridge P is rotated at a predetermined control speed in the counterclockwise direction indicated by an arrow in FIG. 1. The charging roller 2 is rotated by drum 1. In addition, the transfer member 5 is also rotated at a speed corresponding to the speed of the drum 1 in the clockwise direction indicated by the arrow (codirectional with the rotation of the drum 1). The transfer member 5 is an endless belt of a dielectric material having flexibility, and is extended and stretched around a driving roller 5*a*, a secondary transfer opposing roller 5*b* and a tension roller 5*c*. The endless belt extends substantially in the same direction as the moving direction of a drawer member 13 which will be described hereinafter. Further, it extends in the longitudinal direction of the drum 1.

In addition, the developing roller 40 and the supplying roller 43 are rotated at the predetermined control speeds. In synchronism with the drive, a predetermined charging bias voltage is applied to the charging roller 2 at the predetermined control timing in each cartridge P. By this, the surface of the drum 1 is charged uniformly by the charging roller 2 to the predetermined polarity and potential. The scanner unit 3 scans and exposes the surfaces of drums 1 of the cartridges P with the laser beams (LY, LM, LC, LK) modulated in accordance with image signals of the respective colors (Y, M, C, K). By this, electrostatic latent images are formed on the surface of the drum 1 of the cartridges P in accordance with the respective image signals. In each cartridge P, the electrostatic latent image formed on the surface of the drum 1 is developed into a developed image by the developing roller 40. In each cartridge P, the developing roller 40 is supplied with a predetermined developing bias voltage at predetermined control timing. By such an electrophotographic image forming process operation, Y color developer image corresponding to the Y color component of the full-color image is formed on the drum 1 of the cartridge PY.

The developed image is primary transferred onto the transfer member 5 in a primary transfer nip which is a contact portion between the drum 1 and the transfer member 5. Designated by 12 is a primary transfer roller, and is urged toward the drum 1 with the transfer member 5 therebetween. By this, a primary transfer nip is formed. Similarly, an M color developer image in the cartridge PM, a C color developer image in the cartridge PC, and a K color developer image in the cartridge PK are primary transferred onto the transfer member 5 through the drum 1.

In this manner, a four full-color (unfixed) developed image of the Y color, M color, C color and K color is synthetically formed.

Figure 7:
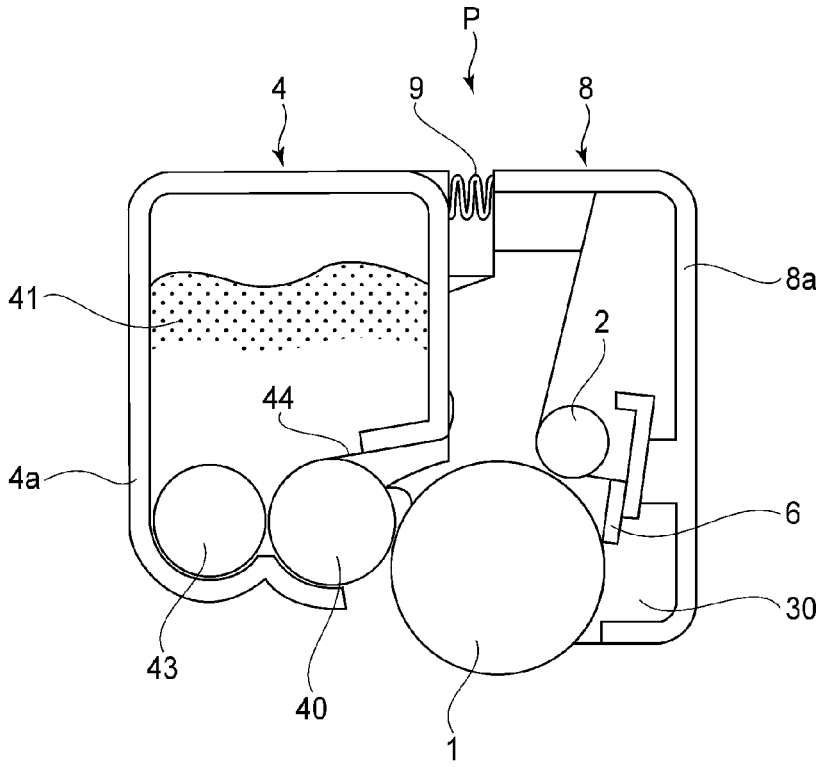
FIG. 7 is a sectional view of a cartridge according to Embodiment 1.

The forward of the colors of the developed images superimposing transferred onto the transfer member 5 is not limited to the above-described order. In each cartridge P, an untransferred residual developer remaining on the surface of the drum after the primary transfer of the developed image onto the transfer member 5 is removed by a blade (cleaning means) 6 and is fed into a residual toner container 30 (FIG. 7). On the other hand, a feeding roller 18 is driven at predetermined control timing. By this, a recording material S in the form of a sheet (toner image receiving member) accommodated in a feeding cassette 17 is fed out. The recording material S is introduced into the secondary transfer nip which is a contact portion between the transfer member 5 and the secondary transfer roller 29 at predetermined control timing by a pair of registration rollers.

To the secondary transfer roller 25, a secondary transfer bias voltage of a predetermined potential and of a polarity opposite to the charge polarity of the developer is applied at predetermined control timing. By this, the developed full-color image is secondary transferred sequentially onto the surface of the recording material S from the transfer member 5 during the recording material S being nipped and fed by the secondary transfer nip The recording material S having passed through the secondary transfer nip is separated from the surface of the transfer member 5 and is introduced to the fixing device 20 and is heated and pressed by the fixing nip.

By this, the developed image are mixed in color and fixed on the recording material S. Then, the recording material S is discharged from the fixing device 20 and is discharged on the discharging tray 24 by the discharging rollers as a full-color print.

The roller 29 is movable between a first position in which it contacts the transfer member 5 to form the secondary transfer nip and a second position in which it is spaced from the intermediary transfer member 5, by a shifting mechanism (unshown). The roller 29 is in the first position during the image forming operation of the device 100 and is in the second position during non-image-formation period. The roller 29 may be always in contact to the transfer member 5.

<Drawer Member (Supporting Member)>

A drawer member 13 will be described. It is a supporting member, and is movable between an inside position supporting the photosensitive drum 1 and an outside position outside of the main assembly.

Here, in this embodiment, the main assembly is the portion other than at least drawer member 13 and the members (parts) which are detachably mountable thereto or fixed thereto, among the various members (parts) which constitute the image forming apparatus 100.

As shown in FIG. 2, the drawer member 13 is movable linearly in the substantially horizontal direction (arrows D1 and D2 directions) relative to the main assembly (insertable and drawable). The drawer member 13 can be moved to the inner position (FIG. 1) in which it is accommodated in an inside of the main assembly and the outer position (FIG. 2) in which it is drawn to an outside of the main assembly.

In the state that the drawer member 13 is in the outer position, the process cartridges P (PY, PM, PC, PK) are mounted by the user to the drawer member 13 in the substantially vertical direction (the direction of arrow C in FIG. 2). In the process cartridge P mounted in this manner, a longitudinal direction (an axial direction of the developing roller 40) thereof is perpendicular to a movement direction of the drawer member 13. The four process cartridges PY, PM, PC, PK are juxtaposed in the movement direction of the drawer member 13.

In the state that such process cartridges P are positioned relative to the drawer member 13, they are moved into the main assembly with the drawer member 13. In the state that the drawer member 13 is in the main assembly, when a door 10 is closed, all the process cartridges are mounted to the predetermined positions in the main assembly P.

In this manner, according to the image forming apparatus 100 according to this embodiment, multiple (four) process cartridges P can be mounted into the main assembly all together, and four process cartridges Ps can be drawn all together to the outside of the main assembly. Therefore, the operativity in the exchange of process cartridge P is excellent, as compared with the case in which the process cartridges are mounted into the main assembly individually.

<Mounting Portion of Drawer Member (Supporting Member)>

Figure 3:
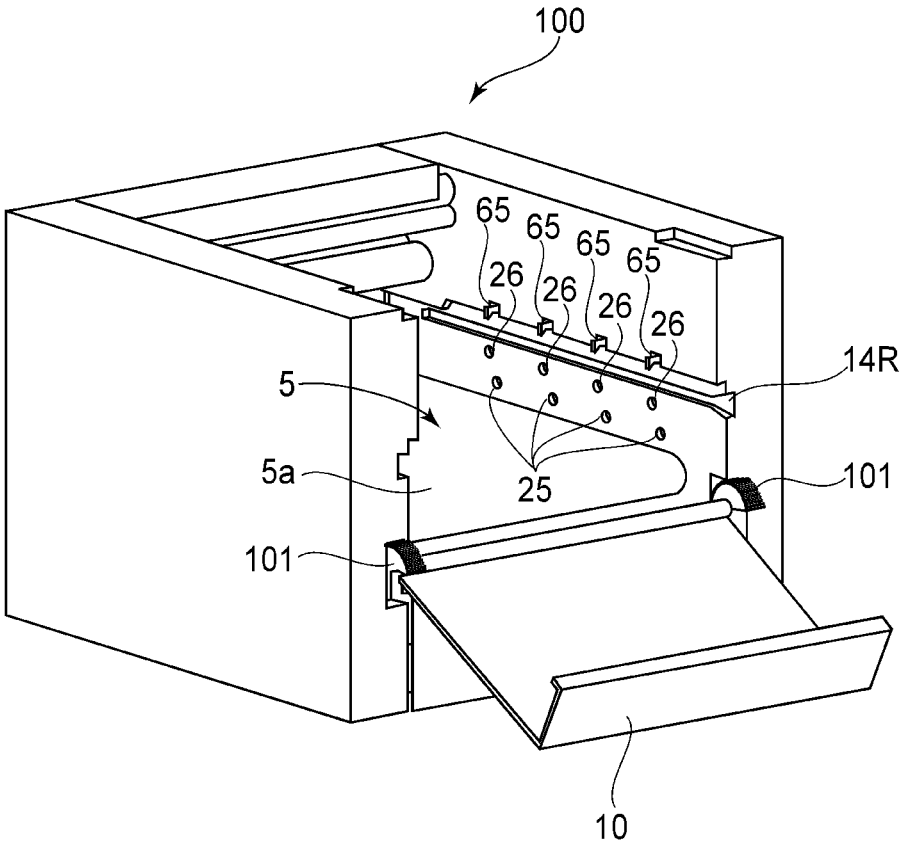
FIG. 3 is an illustration of a drawer member mounting portion in the main assembly of the image forming apparatus of Embodiment 1.
Figure 4:
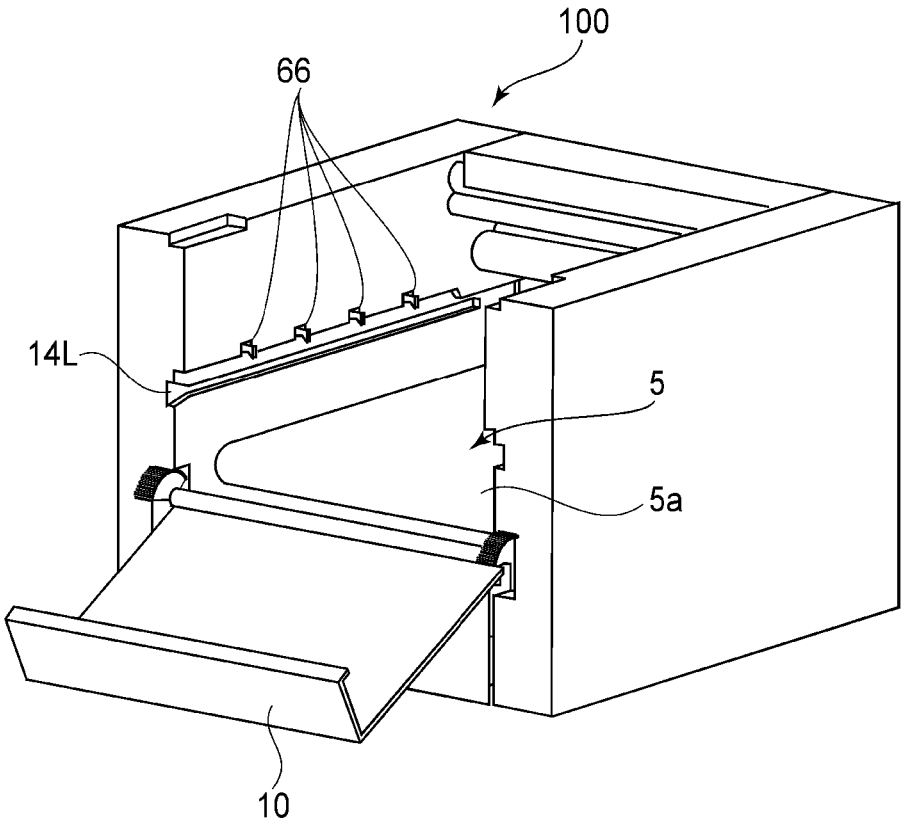
FIG. 4 is an illustration of a drawer member mounting portion in the main assembly of the image forming apparatus of Embodiment 1.

Referring mainly to FIGS. 3 and 4, the structures of the mounting portion for the drawer member 13 in the main assembly will be described. FIGS. 3 and 4 are perspective views illustrating the mounting portion for the drawer member in the main assembly of the image forming apparatus according to Embodiment 1 of the present invention. In FIGS. 3 and 4, the scanner unit 3 and so on are omitted among the members (parts) which constitute the main assembly, for better understanding of the structure of the mounting portion. FIG. 3 and FIG. 4 are the perspective views as seen in different directions.

On an inner wall surface of a main assembly frame, the pair of guide portions 14R, 14L which guide the movement direction of the drawer member 13 is provided opposed to each other. The guide portions 14R, 14L have the function of guiding the portions-to-be-guided 13*a*, 13*b*, 13*c*, and 13*d* (FIG. 5 and FIG. 6) of the drawer member 13 as will be described hereinafter, and have a channel-like section. The guide portions 14R, 14L are extended in the substantially horizontal direction from the neighborhood of an entrance of the main assembly (neighborhood of the door 10) to a rear side, so that the drawer member 13 can be guided from the position for drawing to an outside of the main assembly to the position of being accommodated in the inside of the main assembly.

Above the guide portions 14R, 14L, urging members 65, 66 for pressing and positioning the process cartridge P to the predetermined position are provided. These urging members 65, 66 press process cartridge P, by moving downwardly with the driving force from a main assembly side, and, thereby to position the process cartridge P in the predetermined position in the main assembly. Detailed description will be made hereinafter.

As shown in FIG. 3, below a guide portion 14R, drum coupling members 25 for transmitting the drive to the photosensitive drums 1, and developing device coupling members 26 for transmitting the drive to the developing rollers 40 are arranged in horizontal directions, respectively at regular intervals. The drum coupling member 25 and the developing device coupling member 26 transmit the driving forces from a driving source to the cartridges P. The drum coupling member 25 and the developing device coupling member 26 are retracted within the side wall in the state that the door 10 is opening (open position), and are advanced toward the process cartridge P side in interrelation with the closing operation of the door 10.

<Details of Drawer Member (Supporting Member)>

Figure 5:
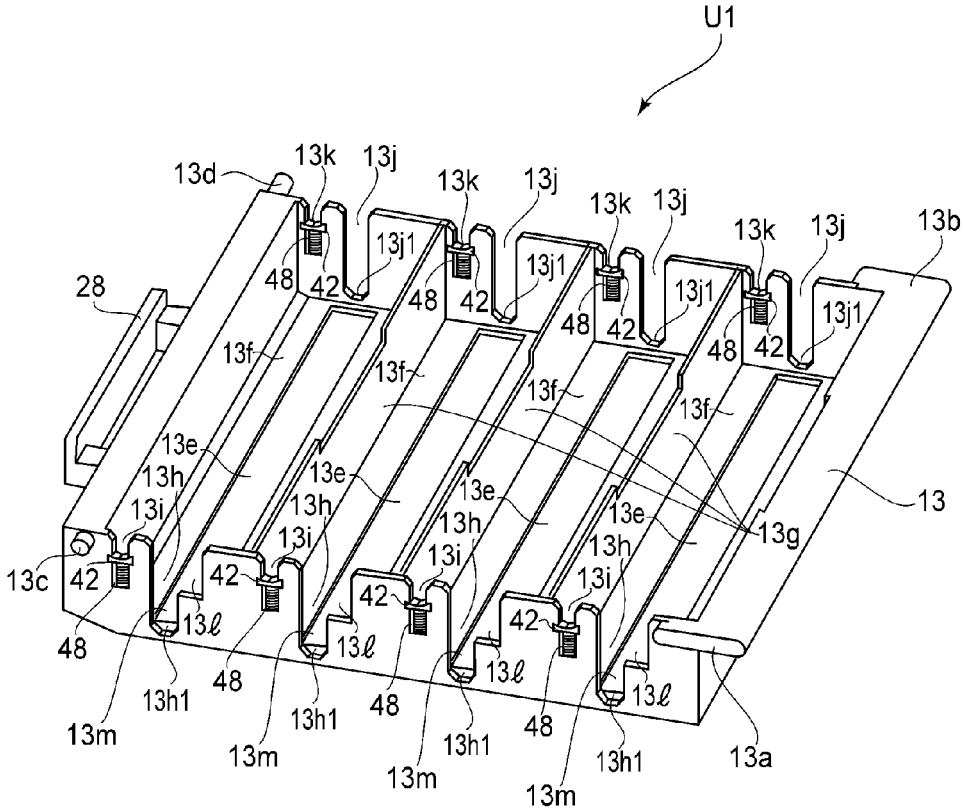
FIG. 5 is an illustration of a drawer unit in Embodiment 1.
Figure 6:
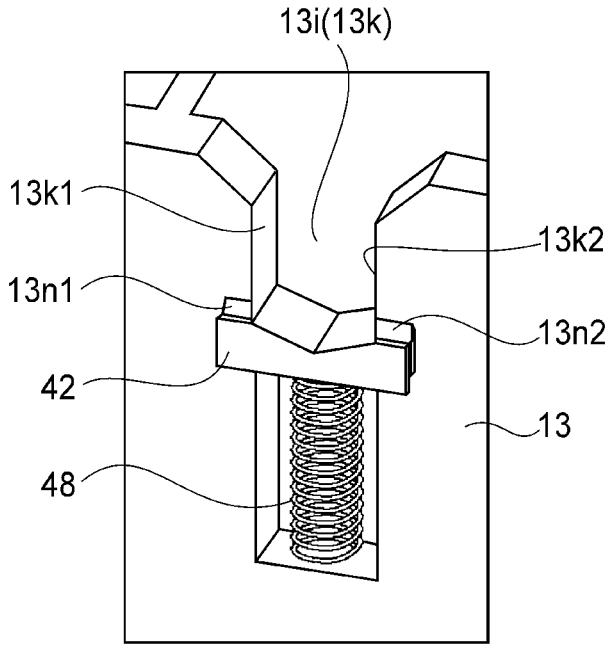
In FIG. 6, (a) is an illustration of a contacting and spacing member provided in the drawer unit in Embodiment 1, and cone (b) is a detailed illustration of the contacting and spacing member.
Figure 6:
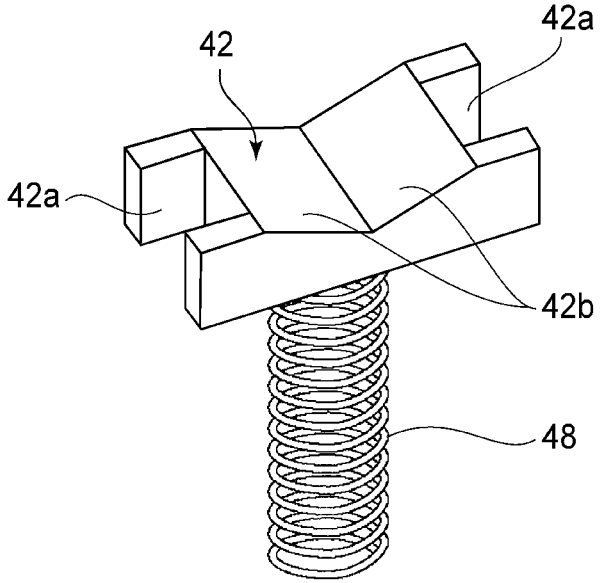

Referring to FIGS. 5 and 6, the drawer member 13 will be described in detail. FIG. 5 is a perspective view of the drawer unit in the image forming apparatus according to Embodiment 1 of the present invention. In FIG. 6, part (a) is a detailed illustration of the neighborhood of the contacting and spacing member 42, and part (b) is a detailed illustration of an urging member 48 and the contacting and spacing member 42.

Four corners of the drawer member 13 is provided with portions-to-be-guided 13*a*, 13*b*, 13*c*, 13*d* to be guided by the guide portions 14R, 14L of the main assembly of the apparatus. The portions-to-be-guided 13*a*, 13*c* is guided by the guide portion 14R, and the portions-to-be-guided 13*b*, 13*d* are guided by the guide portion 14L. The portions-to-be-guided 13*a*, 13*b* are projected outwardly from a side, and extend in the drawing direction so as to prevent inclination of the drawer member 13 in a drawn position. The portions-to-be-guided 13*c*, 13*d* are circular column configurations and project outwardly from a side.

One end portion of the drawer member 13 is provided with a grip portion 28 for manipulation of the drawer unit U1 by the user.

The drawer member 13 is provided with one array of mounting portions 13*f* for mounting the process cartridge P, and the mounting portion 13*f* will be described hereinafter. Between the mounting portions 13*f*, a partition plate 13*g* is provided as an index when the process cartridge P is mounted. Below each mounting portion 13*f*, an opening 13*e* is provided. Through the opening 13*e*, the photosensitive drum 1 of the process cartridge P can contact the transfer member 5.

One end portion and the other end portion of each mounting portion 13*f* are provided with guide portions 13*h*, 13*i*, 13*j*, 13*k* for guiding the process cartridges P into the drawer member 13. Each guide portion extends in the vertical direction. Below the guide portions 13*h*, 13*j*, positioning portions 13*h*1, 13*j*1 for positioning the process cartridge P relative to the drawer member 13 are provided.

As shown in FIG. 5, the drawer member 13 is provided with an opening 13*m* for permitting entrance of the drum coupling member 25, and an opening 13*l* for permitting entrance of the developing device coupling member 26. The drum coupling member 25 and the developing device coupling member 26 enter the opening 13*m* and the opening 13*l* in interrelation with the closing operation of the door 10. The drum coupling member 25 and the developing device coupling member 26 engage with the coupling members of the process cartridge P through the openings 13*m*, 13*l*, respectively.

Each of the guide portions 13*i*, 13*k* is provided with a contacting and spacing member 42. Each guide portion 13*i*, 13*k* has a substantially rectangular groove configuration extending in the same direction as the mounting direction of the cartridge P relative to the drawer member 13. More particularly, it is a recess extending in the moving direction between the first position as a contact position and the second position as a spacing position. In other words, it extends in the vertical direction which is a direction from the photosensitive drum 1 toward the transfer member 5.

The contacting and spacing member 42 is movable in the guide portions 13*i*, 13*k*. The contacting and spacing member 42 is urged upwardly by the urging member 48. The contacting and spacing member 42 is limited by regulating portions 13*n*1, 13*n*2 having a triangular prism configuration so as not to move upwardly beyond them. Furthermore, the contacting and spacing member 42 is provided with a recessed portion-to-be-guided 42*a* to be guided by the guide portions 13*i*, 13*k* so that it is prevented from being dislodged from the drawer member 13 in the left-right direction. The upward movement is limited by the regulating portions 13*n*1, 13*n*2. The urging member 48 urges the contacting and spacing member 42 in the direction opposite to the mounting direction of the cartridge P relative to the drawer member 13. More particularly, it is urged upwardly with respect to the vertical direction. As will be described hereinafter, a V shaped inclined surface 42*b* functions to position the process cartridge P when the drawer member 13 moves while in engagement with portions-to-be-guided 8*f*, 8*g* provided in the process cartridge P.

As described in the foregoing, the drawer unit U1 comprises the drawer member 13, the contacting and spacing member 42, and the urging member 48.

<Process Cartridge>

Figure 8:
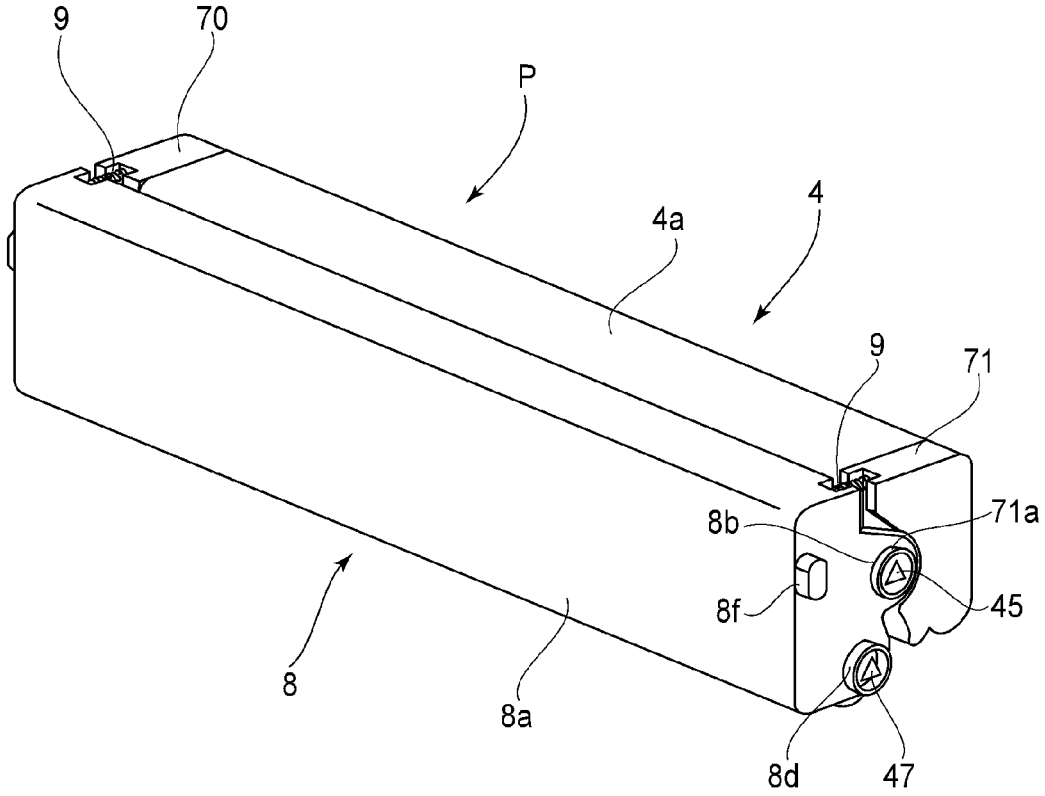
FIG. 8 is an illustration of the cartridge of Embodiment 1 as seen from a driving side.
Figure 9:
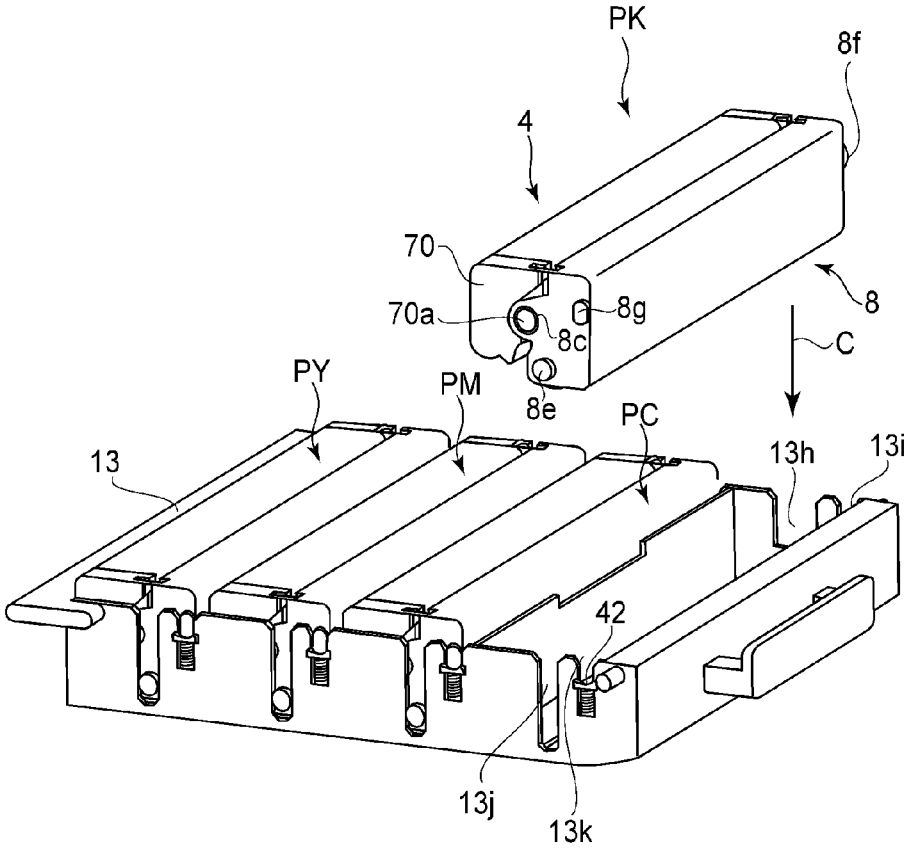
FIG. 9 is an illustration of the cartridge of Embodiment 1 as seen from a non-driving side when it is mounted to the drawer member.

Referring to FIG. 7-FIG. 9, the description will be made as to the process cartridge P mounted to the drawer member 13. FIG. 7 is a schematic sectional view of the process cartridge P according to Embodiment 1 of the present invention. FIG. 8 is a perspective view of the process cartridge P according to Embodiment 1 of the present invention. FIG. 9 is a perspective view illustrating the state that the process cartridge P according to Embodiment 1 of the present invention is mounted to the drawer unit (drawer member) 13.

The process cartridge P comprises a photosensitive member unit 8 and developing unit 4. The photosensitive member unit 8 comprises the photosensitive drum 1, a photosensitive member frame 8*a* supporting the photosensitive member 1, charging means 2, cleaning means 6, and a residual toner container 30 for containing the toner removed by the cleaning means 6. The developing unit 4 comprises the developing roller 40, a developing frame supporting the developing roller 40, a toner supplying roller 43, a developing blade 44, and the toner container 41 which contains the toner used for the image formation.

As has been described hereinbefore, the toner in the toner container 41 is fed to the toner supplying roller 43. By the toner supplying roller 43 and the developing blade 44 press-contacted to the outer periphery of the developing roller 40, the toner is applied to the outer periphery of the developing roller 40, and the charge is applied to the toner. By applying the developing bias from the main assembly to the developing roller 40, the toner is deposited onto the latent image formed on the photosensitive drum 1 to form the toner image. The toner image developed on the photosensitive drum 1 is transferred onto the sheet material S, and thereafter the toner which remains on the photosensitive drum 1 surface is removed by the cleaning means 6 and is accommodated in the residual toner container 30.

Here, when the toner in the toner container 41 is consumed up, the user exchanges process cartridge P, by which the user can carry out the printing again.

As shown in FIG. 8, the one-end portion of the process cartridge P supports a coupling member 47 (drive receiving member) for receiving the driving force from the drum coupling member 25 of the main assembly side rotatably. It also supports a coupling member 45 for receiving the driving force from the development coupling member 26 rotatably.

The coupling member 47 is provided at the end of the photosensitive drum 1, and the photosensitive drum 1 is rotated by the driving force received by the coupling member 47 from the main assembly. The driving force received by the coupling member 45 is transmitted to the developing roller 40 and the toner supplying roller 43 through an unshown intermediate gear to rotate them.

The outer periphery of the coupling member 45 is covered by a cylindrical rib and constitutes an engaging portion 71*a*. The engaging portion 71*a* is provided on a side cover 71 fixed to the outside of the toner container 41. The coupling member 45 is rotatable relative to the engaging portion 71*a*. As shown in FIG. 9, an engaging portion 70*a* is provided on the opposite side from the engaging portion 71*a*. This engaging portion 70*a* is similarly provided on a side cover 70. These engaging portions 71*a*, 70*a* are provided on the developing unit 4.

The photosensitive member frame 8*a* is provided with hole portions 8*b* and 8*c* supporting the engaging portions 71*a*, 70*a*. The hole portions 8*b* and 8*c* provided in the photosensitive member frame 8*a* engage with the engaging portions 71*a*, 70*a* provided in the developing unit 4, by which the photosensitive member unit 8 and the developing unit 4 connect with each other.

Here, the engaging portions 71*a*, 70*a* are movable (rotatable) relative to the hole portions 8*b* and 8*a*, respectively, and therefore, the developing unit 4 can be moved relative to the photosensitive member unit 8. That is, the developing roller 40 is movable relative to the photosensitive drum 1.

As shown in FIG. 7-FIG. 8, between the photosensitive member unit 8 and the developing unit 4, a spring 9 as an urging member is provided. The spring 9 presses the developing roller 40 with the predetermined pressure to the photosensitive drum 1.

As shown in FIG. 8, the outer periphery of the coupling member 47 is covered by the cylindrical rib to form a portion-to-be-guided 8*d*. As shown in FIG. 9, a portion-to-be-guided 8*e* in the form of a cylindrical projection is provided on the opposite side of the portion-to-be-guided 8*d* with respect to the longitudinal direction. As shown in FIG. 8, a portion-to-be-guided 8*f* is provided above the portion-to-be-guided 8*d*, and as shown in FIG. 9, a portion-to-be-guided 8*g* is provided above the portion-to-be-guided 8*d*. The portions-to-be-guided 8*f* and 8*g* have a substantially rectangular configuration extending in the same direction as the mounting direction of the cartridge P relative to the drawer member 12. That is, it is protruded in the moving direction between the first position as the contact position and the second position as the spaced position. In the other words, it extends in the vertical direction which is the direction from the photosensitive drum 1 toward the transfer member 5. The portions-to-be-guided 8*d*, 8*e*, 8*f* and 8*g* have the function of the guide for the mounting, into the drawer member 13, of the process cartridge P, and have a function of positioning the process cartridge P in the drawer member 13.

The portions-to-be-guided 8*f*, 8*g* have a function of receiving a force from the contacting and spacing member 42 provided in the drawer member 13 to space the photosensitive drum 1 from the transfer member 5. The portions-to-be-guided 8*f*, 8*g* have a function of stabilizing the attitude of the photosensitive drum 1 in the drawer member 13. Detail description will be made hereinafter. Therefore, the portions-to-be-guided 8*f*, 8*g* are also urged portions which receives a force from the contacting and spacing member 42.

<Mounting of Process Cartridge to Drawer Member>

Figure 10:
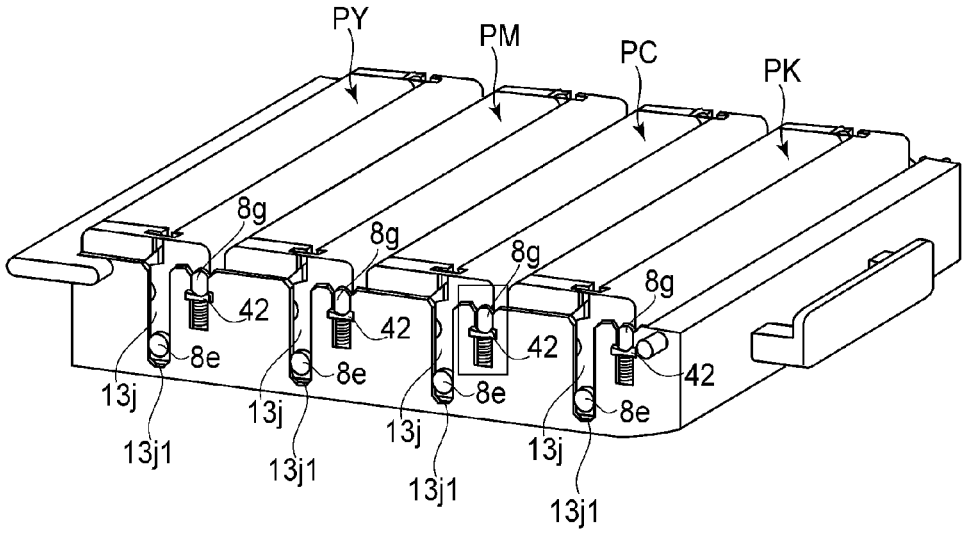
In FIG. 10, (a) is an illustration as seen from the non-driving side in which the cartridge is mounted to the drawer member in Embodiment 1, and (b) is an illustration of the cartridge and the contacting and spacing member.
Figure 10:
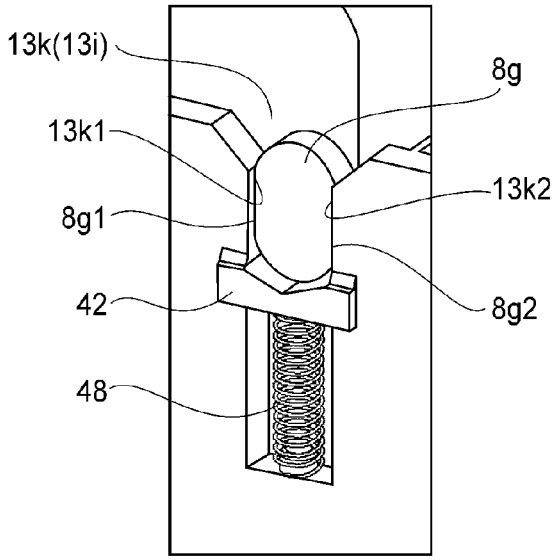
Figure 11:
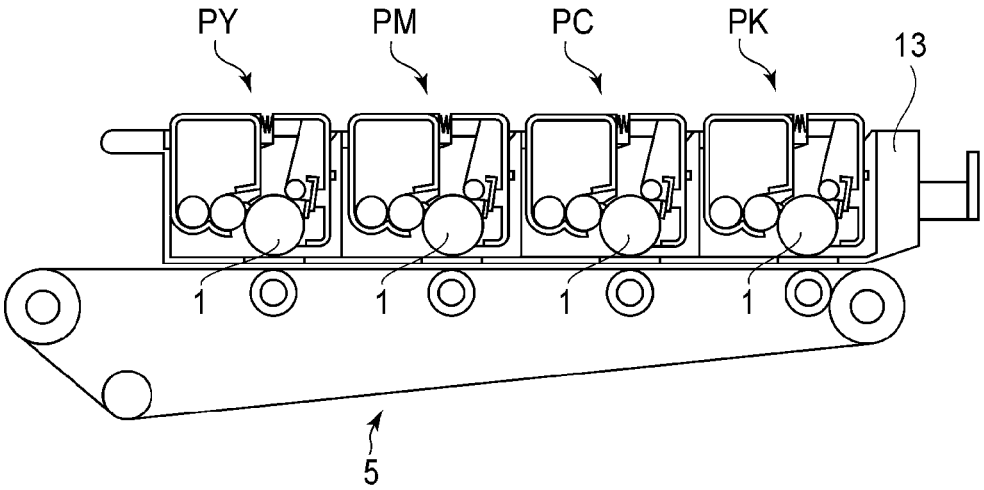
FIG. 11 is a sectional view of the drawer member mounted in the main assembly of the apparatus in Embodiment 1.

Referring to FIG. 9-FIG. 11, the description will be made as to the mounting of process cartridges P (PY, PM, PC, PK) to the drawer member 13. FIG. 9 is a perspective view illustrating the state that the process cartridge according to Embodiment 1 of the present invention is mounted to the drawer member. In FIG. 10 (*a*), all the process cartridges are mounted. FIG. 10 (*b*) shows details of the neighborhood of the moving member 42. FIG. 11 is a schematic sectional view showing a relation relative to the transfer member 5 in the state that the process cartridge is mounted to the drawer member. The other structures of the main assembly of the apparatus are omitted for the sake of simplicity.

The process cartridges PY, PM, PC, PK are mounted into the four mounting portions 13*f* (FIG. 5) provided in the drawer member 13, respectively. The user mounts the process cartridge P in a direction of the arrow C which is substantially the direction of gravity.

In mounting the process cartridge P, first, the user moves it, so that the portions-to-be-guided 8*d*, 8*c* provided at the opposite ends of the process cartridge P are guided by the guide portions 13*h*, 13*j* of the drawer member 13. Then, the user moves it, so that the portions-to-be-guided 8*f*, 8*g* are guided by the guides 13*i*, 13*k*. By this, the process cartridge P is mounted to the inside of the drawer member 13, while being guided by the guide portions 13*h*, 13*i*, 13*j* and 13*k*.

In the process in which the process cartridge P is mounted to the drawer member 13, the portions-to-be-guided 8*f* and 8*g* contact to the contacting and spacing member 42.

The portions-to-be-guided 8*f*, 8*g* provided on the photosensitive member unit 8 abut to the first projection 42*b*, by which the process cartridge P is held in a position higher than the image forming position. As shown in FIG. 2, that is, the surface of the photosensitive drum 1 is held in the position (first position) higher than the surface of the transfer member 5.

Here, the contacting and spacing member 42 is provided at each end of the drawer member 13. The portions-to-be-guided 8*f* and 8*g* which receive the force from the contacting and spacing member 42 is also provided at each side of the photosensitive member unit 8. However, it may be provided on only one side if the surface of the photosensitive drum 1 can be spaced from the surface of the transfer member 5.

As described in the foregoing, in the process of mounting the process cartridge P to the drawer member 13, the process cartridge P is mounted while the surface of the photosensitive drum 1 is spaced from the surface of the transfer member 5. In other words, the process cartridge P is mounted to the drawer member 13 in the state that the contacting and spacing member 42 is in the first position.

<Mounting of Drawer Unit into Main Assembly>

Figure 12:
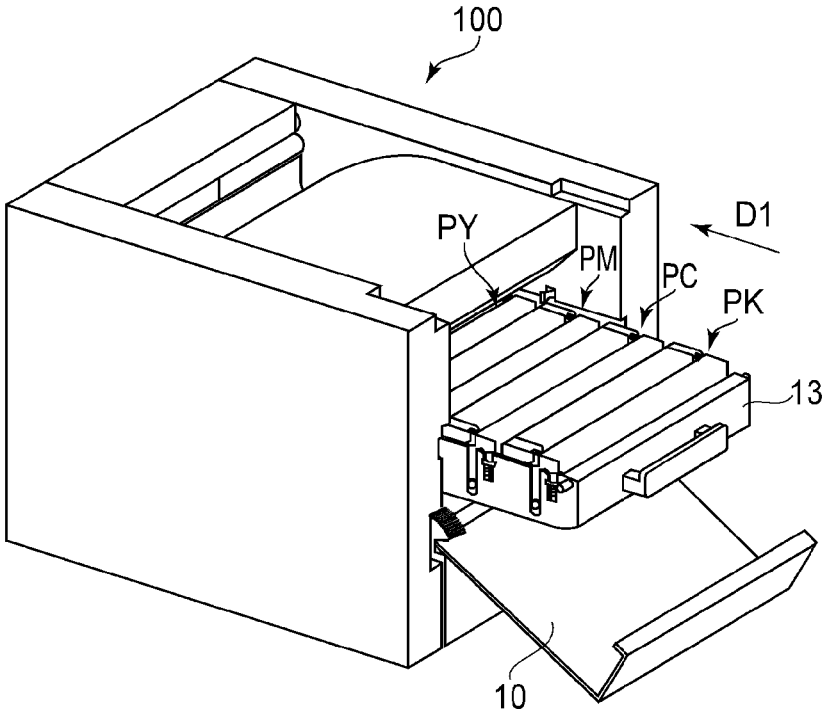
FIG. 12 is an illustration of the drawer member being mounted to the main assembly of the apparatus in Embodiment 1.
Figure 13:
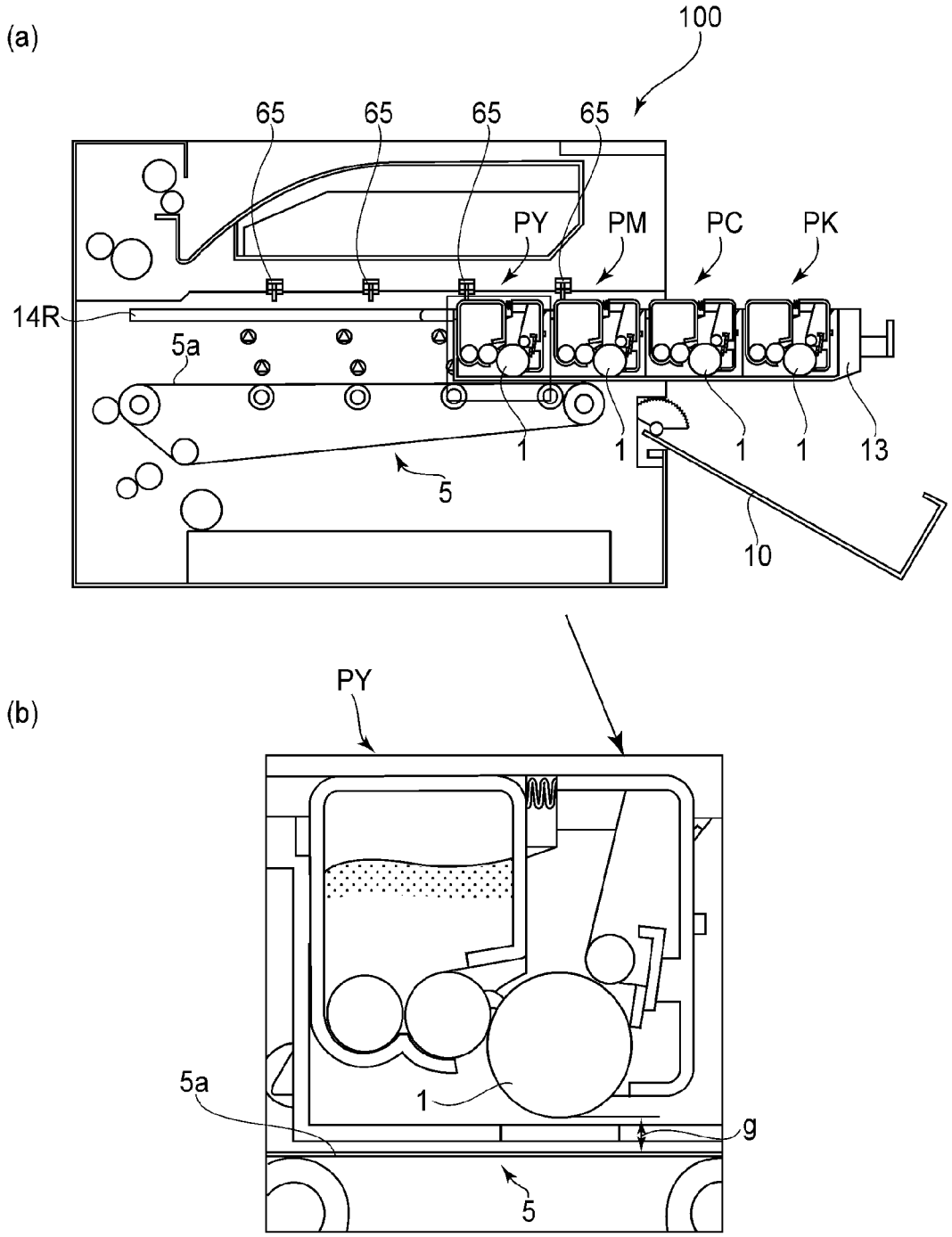
In FIG. 13, (a) is an illustration of the drawer member being mounted to the main assembly of the apparatus in Embodiment 1, and (b) is a detailed illustration of a relation between the cartridge and the transfer member at this time.
Figure 14:
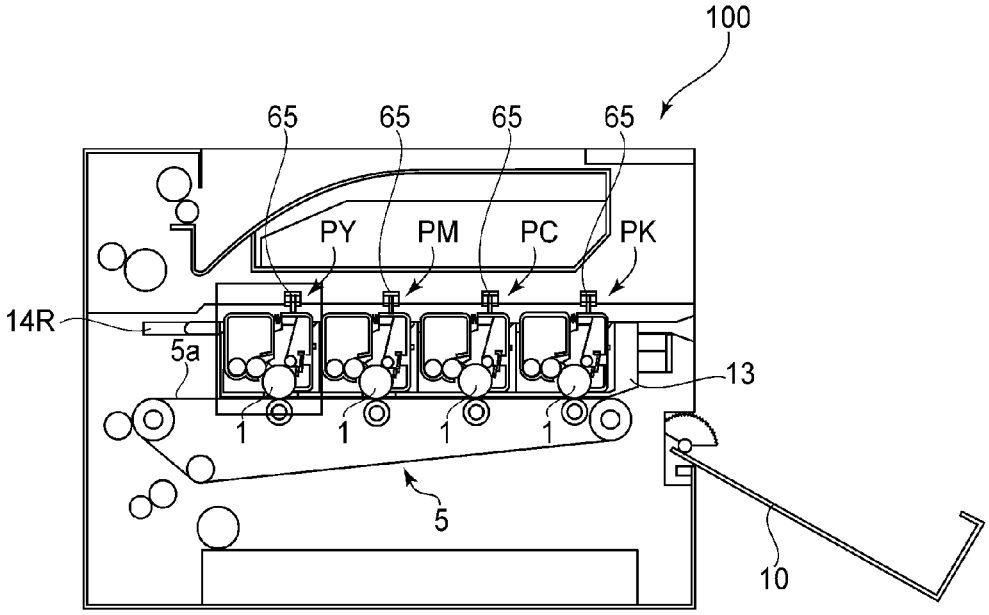
FIG. 14 is an illustration of the drawer member mounted to the main assembly of the apparatus in Embodiment 1.

Referring to FIG. 12-FIG. 14 the description will be made as to the mounting operation of the drawer unit U1 into the main assembly. FIG. 12 is a perspective view illustrating the state that the drawer unit according to Embodiment 1 of the present invention is mounted to the inside of the main assembly. FIG. 13 is a schematic sectional view illustrating the state that the drawer unit according to Embodiment 1 of the present invention is mounted to the inside of the main assembly. FIG. 14 is a schematic sectional view illustrating the state that the drawer unit according to Embodiment 1 of the present invention is mounted to the inside of the main assembly, and the door is open. FIGS. 13 and 14 include the enlarged cross-sectional views of the schematic sectional views of the whole device and the neighborhood of the one photosensitive drum.

As shown in FIG. 12, the drawer unit U1 is mounted in a direction of arrow D1 while the portions-to-be-guided 13*a*, 13*b*, 13*c*, and 13*d* (FIGS. 5, 6) of the drawer member 13 is guided by the guide portions 14R and 14L of the main assembly (FIGS. 3, 4).

During the mounting operation of the drawer unit U1 (drawer member 13), the state that the surface of the photosensitive drum 1 and the surface 5*a* of the transfer member 5 are spaced from each other is maintained. That is, a gap g is provided between the surface of the photosensitive drum 1 and the surface 5*a* of the transfer member 5. Therefore, the drawer unit U1 can be mounted to the inside of the main assembly without the rubbing between the surface of the photosensitive drum 1 and the surface 5*a* of the transfer member 5. During the mounting operation, the drawer unit U1 is moved in substantially parallel with the surface 5*a* of the transfer member 5. During the mounting operation of the drawer unit U1, the contacting and spacing member 42 is placed in the "first position", in which the surface of the photosensitive drum 1 is spaced from the surface 5*a* of the transfer member 5.

As shown in FIG. 14, in the state that the drawer unit U1 has been mounted to the main assembly, the surface of the photosensitive drum 1 and the recording material conveying surface 5*a* of the transfer member 5 are still spaced from each other. The drawer unit U1 is placed at a predetermined position in the state that it is in the inner position.

In the state of FIG. 10, the door is closed. By the closing operation of the door 10, the drum coupling member 25 and the development coupling member 26 (FIG. 3) enter the opening portion 13*m* and 13*l* of the opening portion (FIG. 5) provided in the drawer member 13, respectively.

Figure 15:
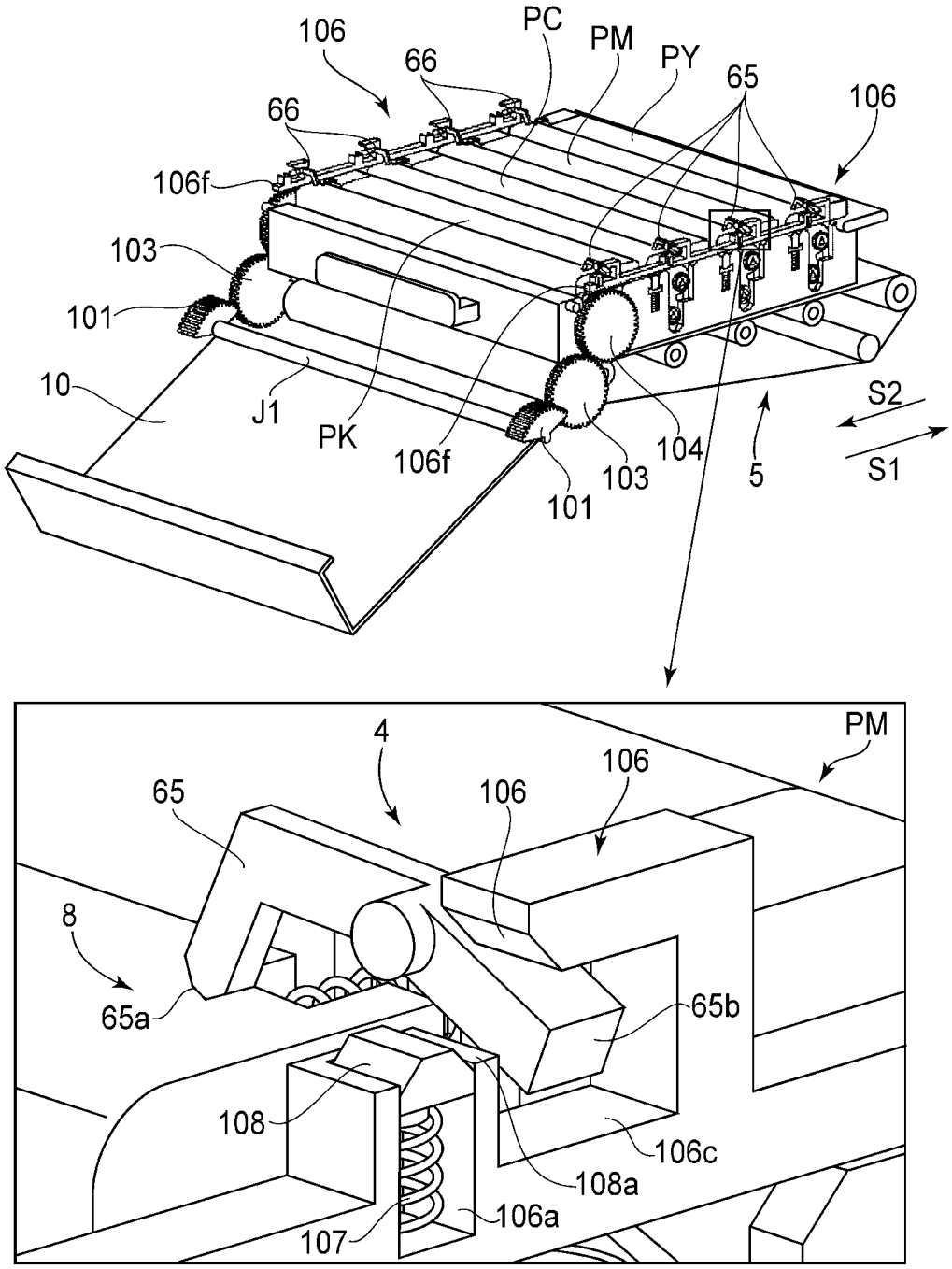
FIG. 15 is an illustration in which an urging member does not urge the cartridge in Embodiment 1.
Figure 16:
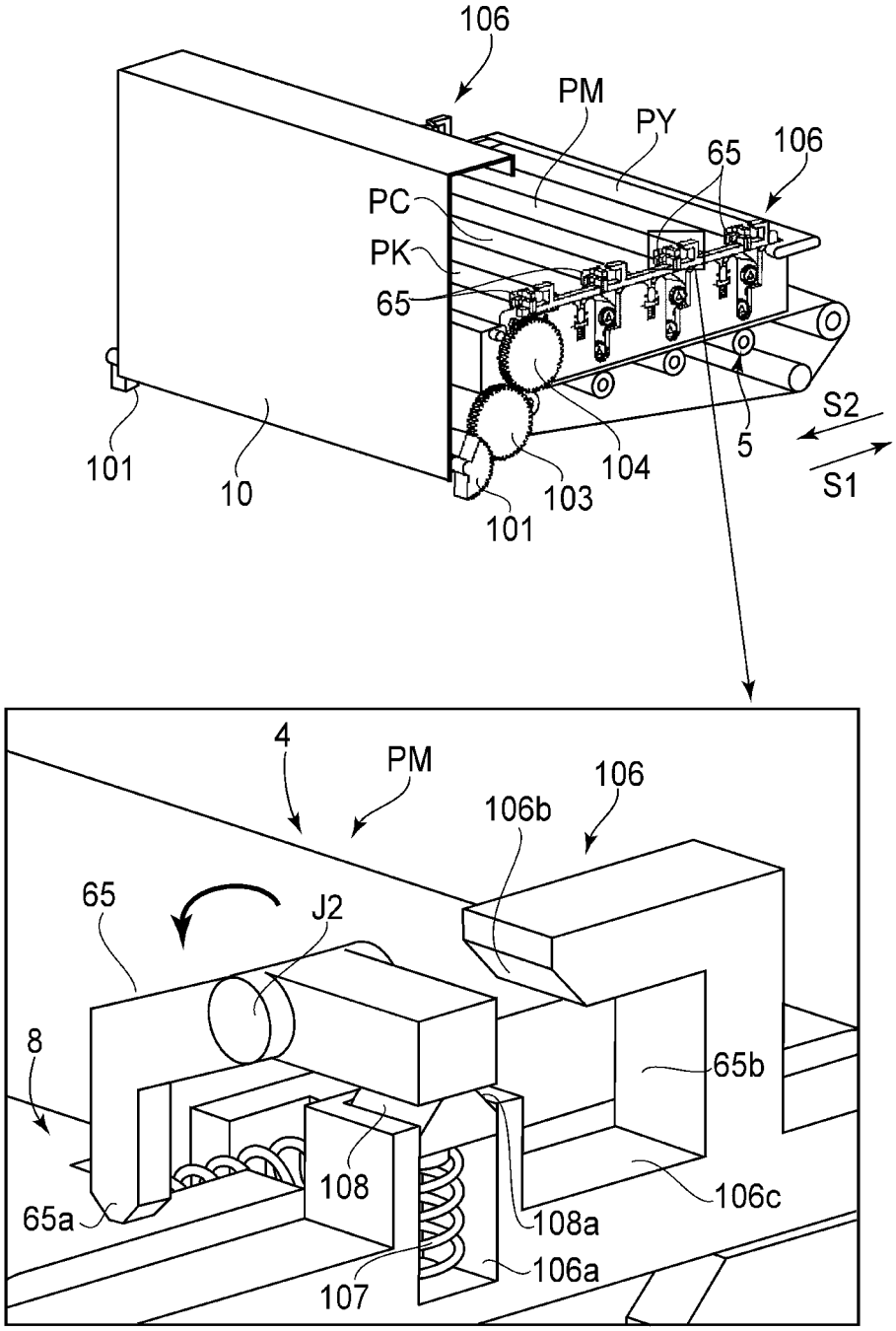
FIG. 16 is an illustration in which the urging member urges the cartridge in Embodiment 1.

Referring to FIGS. 15, 16, the description will be made as to connecting means for connecting between urging members 65, 66 and the door 10. FIG. 15 shows a state in which the door 10 is opening, and FIG. 16 shows a state in which the door 10 is closed. The structures other than the door 10, the urging member 65 the connecting means or the like are omitted.

As shown in FIG. 15, the opposite ends of the rotation shaft J1 of the door 10 are provided with sector teeth gears 101, respectively. The gears 101 rotate in interrelation with the door 10. The gears 101 transmit the drive to a rail unit 106 through middle gears 103 and transmission gears 104. One end portion of the unit 106 is provided with rack portions 106*f* for engaging with the gears 104. Therefore, in accordance with the opening and closing operation of the door 10, the gears 103, 104 rotate to move the unit 106 in the direction of arrows S1, S2. The unit 106 is provided with an urging member 107 for urging the urging members 65, 66, and an urging piece 108 mounted on a free end of the urging member 107. The urging member 107 and the urging piece 108 are accommodated in recesses 106*a* and are movable in the vertical direction. In a downstream side of the recess 106*a* with respect to an inserting direction of the drawer member 13, a force applying portion 106*b* for moving the urging members 65, 66 from an urging position (FIG. 1) to a non-urging position (FIG. 14) are provided. The mechanism of the urging members 65, 66 is common, and therefore, the description will be made only as to the urging member 65.

In the state the FIG. 15, the door 10 is closed. The gear 101 moves the unit 106 in the direction of an arrow S1 through the gears 103, 104. The urging member 65 taking the non-urging position (FIG. 14) is contacted to a taper surface 108*a* provided on the urging piece 108 at the one end portion 65*b* and rotates in the direction indicated by the arrow about the rotation shaft J2. An urging part 65*a* provided at the other end of the urging member 65 elastically urges an upper surface of the cartridge P by the rotating operation thereof to move the cartridge P downwardly along the guide portions 13*h*, 13*i*, 13*j*, 13*k*. The opposite ends of the rotation shaft J2 of the urging member 65 are rotatably supported by the main assembly of the apparatus unshown here.

The urging member 107 and the urging piece 108 become in a compressed state in the recess 106*a*, and move the cartridge P by the urging force corresponding to an amount of the compression of the urging member 107, and finally urge the cartridge P to the drawer member 13. Here, the urging force of the urging member 107 is set to be higher than the urging force of the urging member 48 provided in the drawer member 13, so that a predetermined urging force is generated.

As shown in FIG. 1, by the urging of the urging members 65, 66, the surface of the photosensitive drum 1 and the surface 5*a* of the transfer member 5 are contacted to each other (contact position, second position). This is accomplished by the contacting and spacing member 42 having been spacing the surface of the photosensitive drum 1, and the surface 5*a* of the transfer member 5 moving from the first position to the second position.

When the predetermined image forming operation is completed, and the door 10 is opened, the gear 101, the gear 103, and the gear 104 rotate in the opposite direction. By this, the unit 106 moves in the direction indicated by an arrow S2. One end portion 65*b* of the urging member contacts to the force applying portion 106*b* (taper surface) of the unit 106 to rotate about the rotation shaft J2 to the non-urging position shown in FIG. 15. Said one end portion 65*b* is accommodated in a recess 106*c* provided in the unit 106. The urging member 107 and the urging piece 108 return to the original positions. In the cartridge P released from the urging members 65, 66, the surface of the photosensitive drum 1 and the surface 5*a* of the transfer member 5 are spaced again (first position) by the urging force of the urging member 48 through the contacting and spacing member 42.

<Position Regulation of Cartridge in Drawer Unit>

As described hereinbefore, the portions-to-be-guided 8*f*, 8*g* of the process cartridge P receives the force from the contacting and spacing member 42 provided in the drawer member 13 to space the photosensitive drum 1 from the transfer member 5. The portions-to-be-guided 8*f*, 8*g* function as portions-to-be-regulated. The portions-to-be-guided 8*f*, 8*g* has a columnar shape extending in the same direction as the mounting direction of the cartridge P relative to the drawer member 13. In other words, it extends in the direction from the photosensitive drum 1 toward the transfer member 5.

As shown in FIGS. 10, 11, the cartridge P mounted to the drawer member 13 is spaced from the transfer member 5 by the contacting and spacing member 42. At this time, the portion-to-be-guided (portion-to-be-regulated) 8*g* (8*f*) receives the spacing force directly from the contacting and spacing member 42. The cartridge P is maintained at the spacing position (FIG. 14) which is one step higher than the normal image formation position (FIG. 1) by the contacting and spacing member 42 in the drawer member 13. In such a state, the drawer member 13 is mounted into the main assembly of the apparatus.

The drawer member 13 and the portion-to-be-guided (portion-to-be-regulated) 8 *g* (8*f*) have structures for stabilizing the attitude of the cartridge P in the drawer member 13. More particularly, when the contacting and spacing member 42 holds the portion-to-be-guided 8 *g* (8*f*) by the positioning portion 42*b*, flat surface portions 8*g*1, 8*g*2 which are parts of the columnar shape of the portion-to-be-guided 8*g* (8*f*) contact the flat surface portions 13*k*1, 13*k*2 of the guide portion 13*k* (13*i*) (regulating portion). Therefore, as shown in (a) of FIG. 17, the attitude of the cartridge P is stabilized in the drawer member 13. That is, only the portion-to-be-guided 8*g* (8*f*) is enough to position the cartridge P relative to the drawer member 13 and to limit the rotation thereof. Therefore, the photosensitive drum 1 is limited in the movement toward transfer member 5 (direction of arrow). Without such structures, that is, in the case that the portion-to-be-guided 118 is cylindrical, the cartridge P2 tends to rotate about the portion-to-be-guided 118 in the direction indicated by the arrow, as shown in FIG. 18 (the gravity center is G). In such a case, the photosensitive drum 1 tends to move to the position shown in the chain lines, and therefore, the distance between the transfer member 5 and the photosensitive drum 1 is not stabilized. It is necessary that the gap g between the surface of the photosensitive drum 1 and the surface 5*a* of the transfer member 5 is large to assuredly prevent sliding between the photosensitive drum 1 and the transfer member 5. Then, the main assembly of the apparatus is upsized. According to this embodiment, flat surface portion 8*g*1, 8*g*2 of the portion-to-be-guided 8*g* (8*f*) (portion-to-be-regulated) is limited by the flat surface portions 13*k*1, 13*k*2 of the guide portion 13*k* (13*i*) (regulating portion), by which the attitude of the cartridge P in the drawer member is regulated. By this, the gap g between the surface of the photosensitive drum 1 and the surface 5*a* of the transfer member 5 can be minimized, thus accomplishing the downsizing of the main assembly of the apparatus 100.

Figure 17:
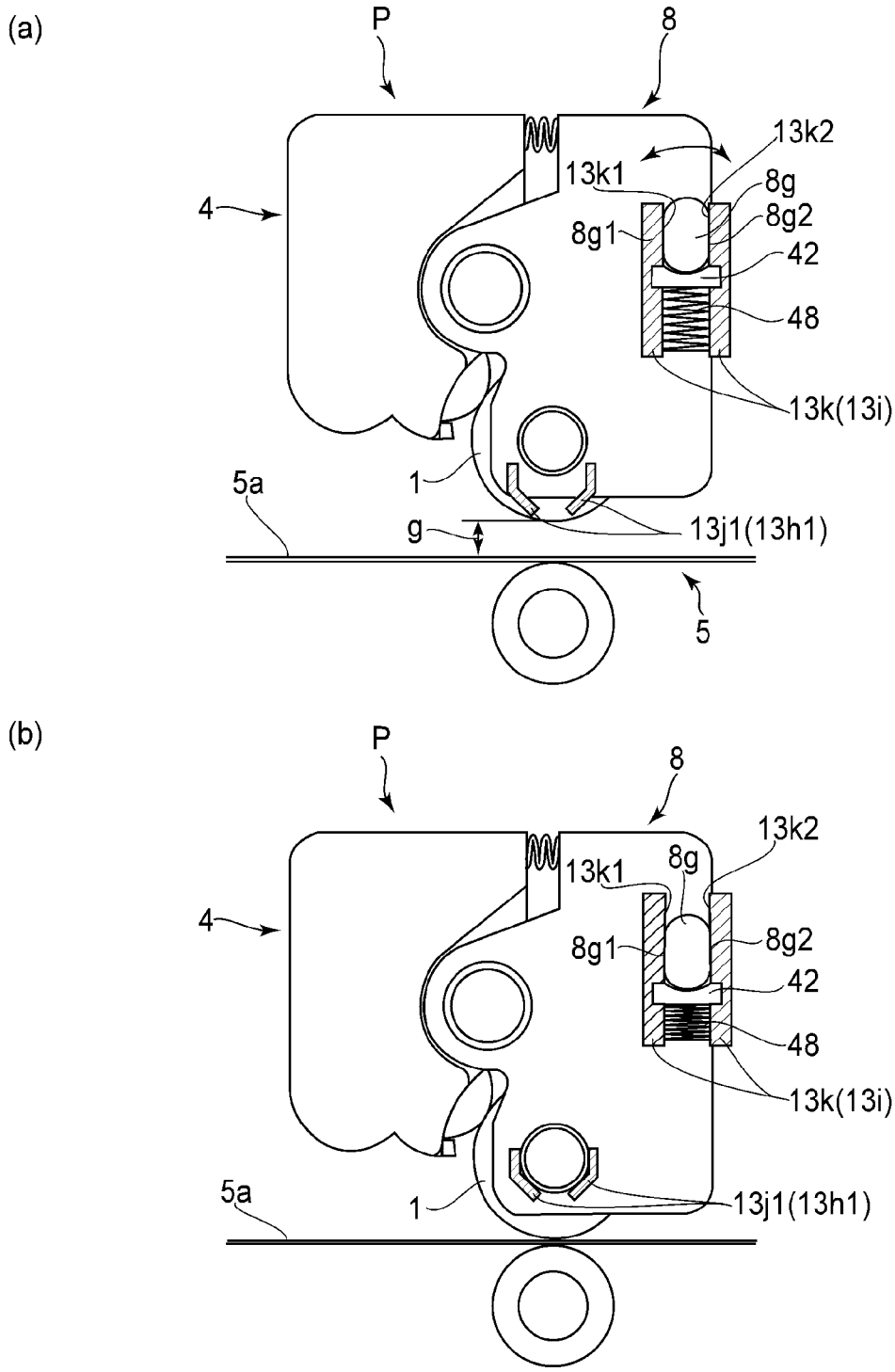
In FIG. 17, (a) is an illustration of the contacting and spacing member and the cartridge in a spacing position in Embodiment 1, and (b) is an illustration of the contacting and spacing member and the cartridge in a contact position in Embodiment 1.
Figure 18:
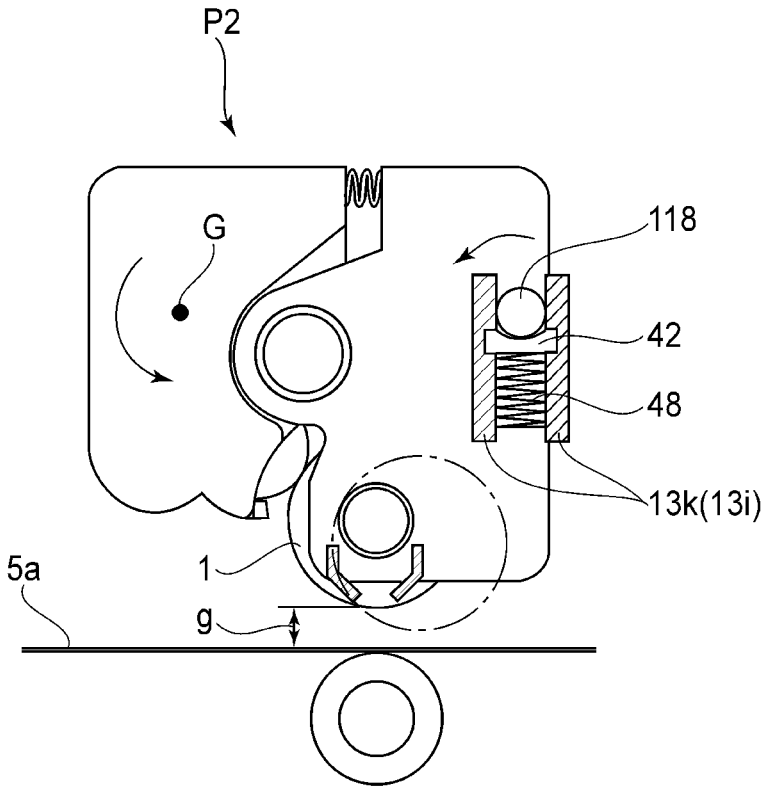
FIG. 18 is an illustration showing a comparison example of Embodiment 1.

Part (b) of FIG. 17 shows the state in which the cartridge P is urged by the urging members 65, 66. The cartridge P is positioned to the positioning portion 13*j*1 (13*h*1) provided in the drawer member 13. Furthermore, by the portion-to-be-guided 8*g* (8*f*) being limited in the position with respect to the rotational moving direction by the guide portion 13*k* (13*i*), the position of the cartridge P is determined in the main assembly of the apparatus 100. Thus, the portion-to-be-guided 8*g* (8*f*) (the portion-to-be-regulated) limits the position of the cartridge P when the photosensitive drum 1 and the transfer member 5 are spaced from each other and when the image forming operation is carried out. Therefore, it is unnecessary to provide a special guide portion for the purpose of limiting the position when they are spaced.

Advantages of this Embodiment

As described in the foregoing, according to the image forming apparatus 100 of this embodiment, the contacting and spacing member 42 is capable of taking the first position (spacing position) and the second position (contact position). And, in the mounting and demounting operation of the drawer member 43, at least the photosensitive drum 1 is in the position spaced from the transfer member 5. By this, the non-contact state between the photosensitive drum 1 and the transfer member 5 can be established during the drawing operation of the drawer unit U1 (drawer member 13).

In the image forming apparatus 100 according to this embodiment, when the photosensitive drum 1 is spaced from the transfer member 5, the position of the cartridge P in the drawer member 13 is regulated, so that the main assembly of the apparatus can be downsized.

In this embodiment, the photosensitive drum 1 is detachably mountable relative to the drawer member 13. However, this embodiment is applicable to a type in which the photosensitive drum 1 is provided in the drawer member beforehand. In such a case, when the photosensitive drum 1 is exchanged, the drawer member having it is exchanged.

In this embodiment, the transfer member 5 is an intermediary transfer member. However, the present invention is applicable to a direct transfer material (sheet material S) which is fed to the surface and onto which the developed image is directly transferred from the photosensitive drum 1.

<Modified Example not Having Partition>

Figure 21:
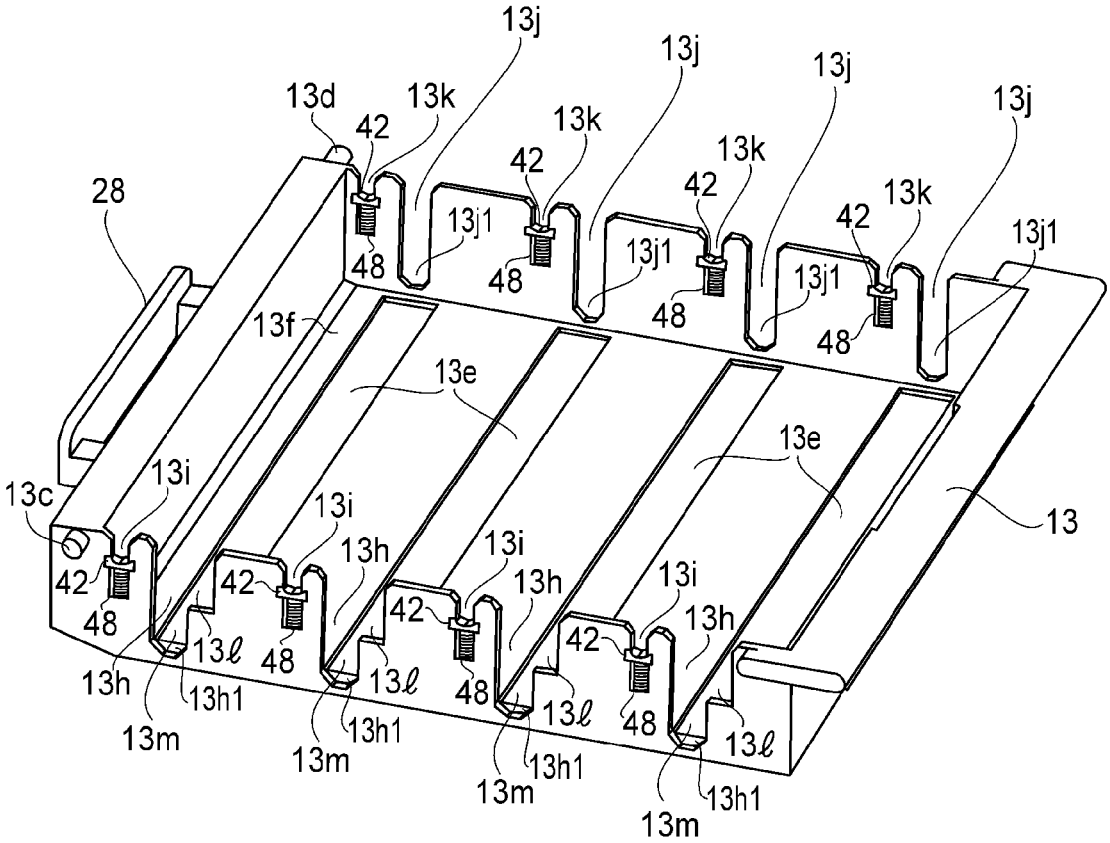
FIG. 21 is an illustration in which the cartridge is mounted to a drawer member in a modified example of Embodiment 1.
Figure 22:
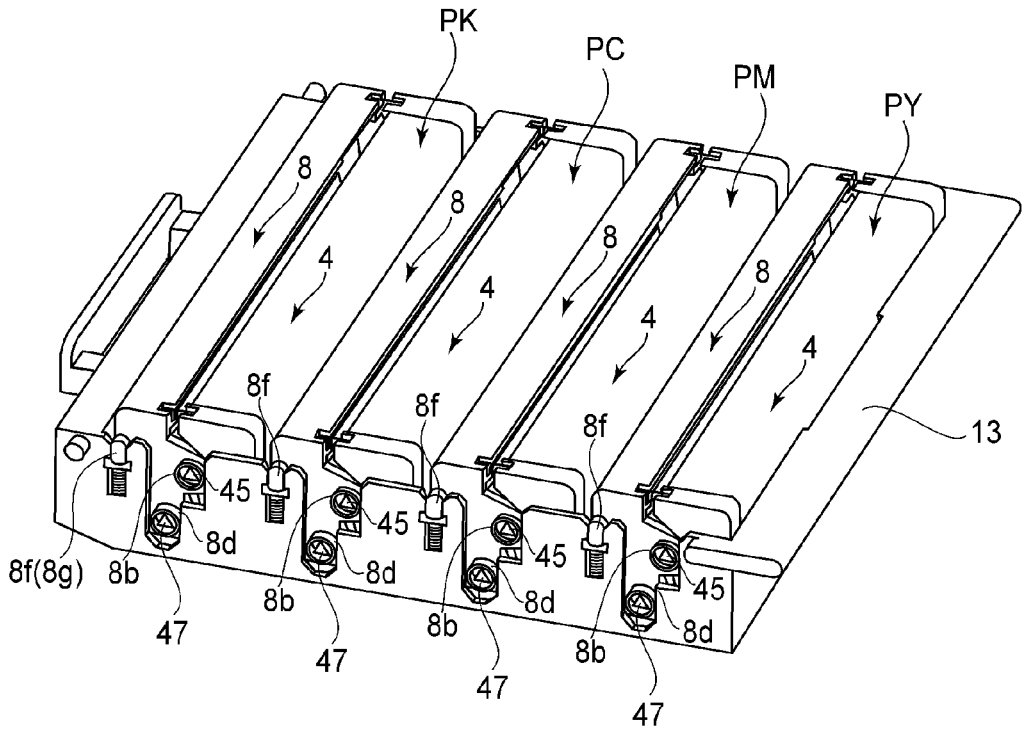
FIG. 22 is an illustration in which the cartridge is mounted to the drawer member in the modified example of Embodiment 1.

In the above-described embodiment, as shown in FIG. 5, the partition plate 13*g* is provided between adjacent mounting portions 13*f* for the cartridges P. However, as described hereinbefore, by the engagement between the guide portion 13*k* (13*i*) and the portion-to-be-guided 8*g* (8*f*), the rotation of the cartridge P is limited also when the contacting and spacing member 42 is placed in the first position and the second position. Therefore, as shown in FIGS. 21, 22, the cartridge P can be supported by the drawer member 13, without the partition plate. With such a structure, the spaces occupied by the partition plates can be saved, and therefore, the length of the drawer member 13 in the moving direction can be shortened. Therefore, the image forming apparatus 100 can be downsized.

Embodiment 2

Figure 19:
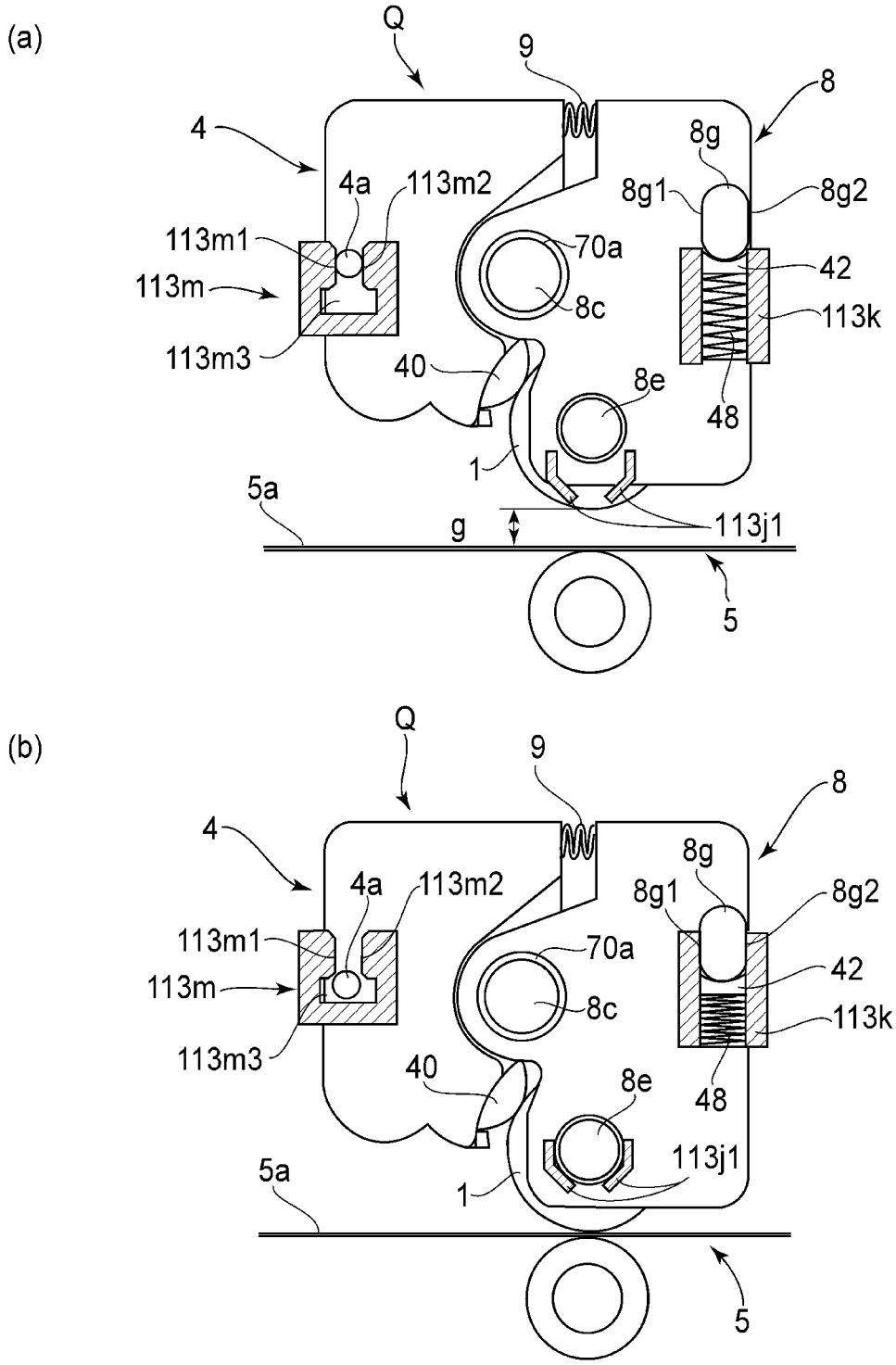
In FIG. 19, (a) is an illustration of the contacting and spacing member and the cartridge in a spacing position in Embodiment 2, and (b) is an illustration of the contacting and spacing member and the cartridge in a contact position in Embodiment 2.

Referring to FIG. 19, a second embodiment will be described. In the 19, (a) is a schematic view showing a relation between a cartridge Q and a transfer member 5 in a spacing position. Part (b) of FIG. 19 is a schematic view showing a relation between the cartridge Q and the transfer member 5 in an image forming position.

In Embodiment 1, the portion-to-be-guided 8*g* (8*f*) for the position regulation in drawer member 13 in spacing position (first position) limits the position of the cartridge also during the image formation. In this embodiment, the regulation of the cartridge position in the drawer member in the spacing position is different from the regulation of the cartridge position during the image formation. As to the other structures, the same reference numerals as in Embodiment 1 are assigned to the elements having the corresponding functions in this embodiment, and the detailed description thereof is omitted for simplicity.

As shown in part (a) of FIG. 19, a developing unit 4 of the cartridge Q of this embodiment is provided with a portion-to-be-guided 4*a*. The portion-to-be-guided 4*a* which functions as a first portion-to-be-regulated has a circular column configuration (it may be rectangular-shape as in Embodiment 1). Similarly to the Embodiment 1, a photosensitive member unit 8 is provided with a portion-to-be-guided 8*g* which functions as a second portion-to-be-regulated. The drawer member 113 is provided with a guide portion 113*k* and a positioning portion 113*j*1 similarly to the Embodiment 1, and in addition, is provided with a guide portion 113*m* which functions as a first regulating portion. The portion-to-be-guided 4*a* and the guide portion 113*m* are provided on the opposite side with respect to the longitudinal direction.

In this embodiment, a curved surface portion of the portion-to-be-guided 4*a* is contacted to flat surface portions 113*m*1, 113*m*2 of the guide portion 113*m* (regulating portion) when a contacting and spacing member 42 holds the portion-to-be-guided 8*g* as a portion-to-be-regulated in the spacing position. The flat surface portions 113*m*1, 113*m*2 extends in the vertical direction. Therefore, the rotation of the cartridge Q about the portion-to-be-guided 8*g* contacted with the contacting and spacing member 42 is limited by the contact between the portion-to-be-guided 4*a*, respectively the guide portion 113*m*. Furthermore, the flat surface portions 113*m*1, 113*m*2 extend in the vertical direction, and therefore, the force applied by the weight of the developing unit 4 to the flat surface portions 113*m*1 and 113*m*2 is small. Since the force to the flat surface portions 113*m*1, 113*m*2 is small, the position of the developing unit 4 in the drawer member 113 is stabilized. If the flat surface portion is perpendicular to the vertical direction, the force applied to the flat surface portion by the weight of the developing unit 4 is large, and by the reaction force, the developing unit 4 tends to rotate about the engaging portion 70*a* relative to the photosensitive member unit 8. Therefore, the position of the developing unit 4 in the drawer member 113 is not stabilized with the result of upsizing of the drawer member. By the rotational position regulation of the cartridge Q by the flat surface portions 113*m*1, 113*m*2 extending in the vertical direction, the drawer member 113 can be downsized.

According to this embodiment, similarly to the Embodiment 1, during manipulation of the drawer member, the contact between the photosensitive drum 1 and the transfer member 5 can be avoided. In addition, a gap g between the surface of the photosensitive drum 1 and a surface 5*a* of the transfer member 5 can be minimized, and therefore, the main assembly of the apparatus can be downsized. In this embodiment, the portion-to-be-guided 8*g* as the portion-to-be-regulated is not limited by the guide portion 113*k* as the second regulating portion. Therefore, the high of the drawer member 113 can be reduced correspondingly.

In FIG. 19, (b) shows a state in which the cartridge Q is urged by the urging members 65, 66 (during image formation). The contacting and spacing member 42 is in the second position. The cartridge Q is positioned to the positioning portion 113*j*1 (13*h*1) provided in the drawer member 113. By the portion-to-be-guided 8*g* functioning portion-to-be-regulated contacting to the guide portion 113*k* as the regulating portion, the position is limited with respect to the rotational moving direction, so that the position of the cartridge Q in the main assembly of the apparatus is determined. At this time, the portion-to-be-guided 4*a* is released from the guide portion 113*m*. More particularly, the portion-to-be-guided 4*a* is released by being at the retraction portion 113*m*3 provided toward the transfer member 5. Therefore, during the image formation, the position of the developing unit 4 is not regulated by the drawer member 113, so that no influence is imparted to the urging force of the developing roller 40 to the photosensitive drum 1. As described with Embodiment 1, a spring 9 as an urging member is reception provision between the photosensitive member unit 8 and the developing unit 4. By the spring 9, the developing roller 40 is urged toward the photosensitive drum 1 at a predetermined pressure if the portion-to-be-guided 4*a* is guided by the guide portion 113*m* also during the image formation, the developing roller 40 is not contacted to the photosensitive drum 1 at a stabilized pressure, with the result of deterioration of the image quality. However, according to this embodiment, the portion-to-be-guided 4*a* retracts to the retraction portion 113*m*3, so that such a problem can be avoided.

As described in the foregoing, according to this embodiment, the portion-to-be-guided 4*a* can be provided in the developing unit 4, and therefore, the latitude in the design is better than in Embodiment 1. Because of this, the portion-to-be-guided 4*a* can be placed below the portion-to-be-guided 8*g* (toward the transfer member 5), and therefore, the drawer member 113 can be downsized.

Also in this embodiment, the rotation of the cartridge Q is limited by the guide portion 113*k* and the guide portion 113*m* when the contacting and spacing member 42 is in the first position and when it is in the second position. Accordingly, similarly to the Embodiment 1, the cartridge Q can be supported in the drawer member 13 even if no partition plate is provided, and therefore, the image forming apparatus 100 can be downsized.

Embodiment 3

Figure 20:
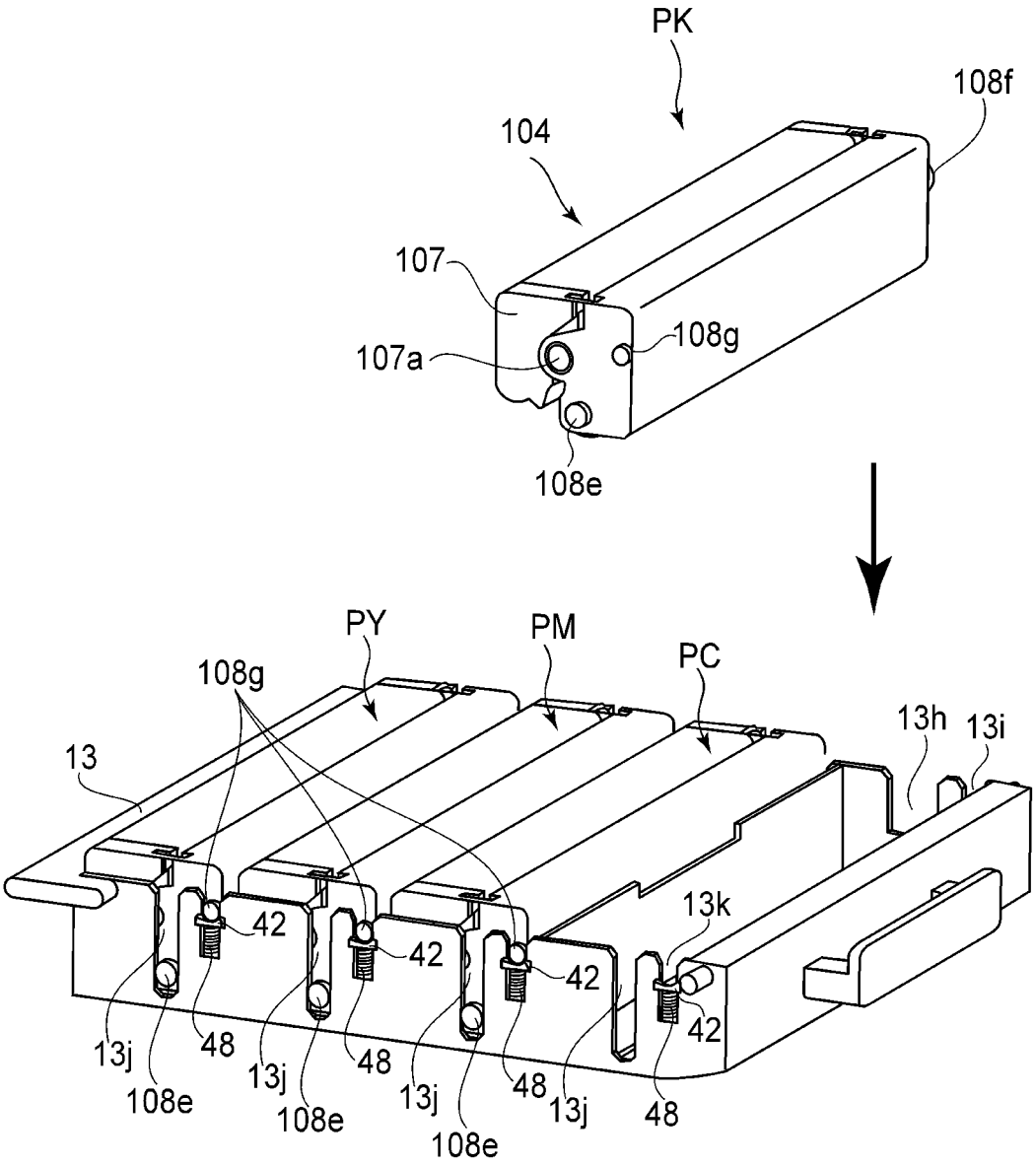
FIG. 20 is an illustration of the cartridge of Embodiment 3 as seen from a non-driving side when it is mounted to the drawer member.

Referring to FIG. 20, a third embodiment of the present invention will be described.

In Embodiment 1, the portions-to-be-guided 8*g*, 8*f* has a projected configuration extending in the moving direction. By doing so, the rotation of the cartridge P relative to the supporting member 13 is limited by the portions-to-be-guided 8*g*, 8*f*.

In Embodiment 3, portions-to-be-guided 108*g*, 108*f* which are a second portion-to-be-regulated is a projection having a round cross-section, and are guided along guide portions 13*k*, 13*i* which are second regulating portions. Similarly to the Embodiment 1, to the portions-to-be-guided 108*g*, 108*f*, a contacting and spacing member 42 is contacted and urged. A portion-to-be-guided 108*e* which is a first portion-to-be-regulated is also a projection having a round cross-section, and is guided by the guide portion 13*j* is an a first regulating portion with such a structure, the rotation of the cartridge P relative to the supporting member 13 is limited by the portions-to-be-guided 108*g*, 108*f*, 108*e*, and by the contacting and spacing member 42 taking a first position and a second position, the spacing and the contact can be established between the photosensitive drum 1 and the transfer member 5.

Also in this embodiment, the rotation of the cartridge R is limited by the guide portions 13*k*, 13*i*, and 13*j* when the contacting and spacing member 42 takes the first position and when it takes the second position. Accordingly, similarly to the Embodiment 1, the cartridge Q can be supported in the drawer member 13 even if no partition plate is provided, and therefore, the image forming apparatus 100 can be downsized.

The other functions, structures and effects are similar to Embodiment 1.

As described in the foregoing, according to the present invention, when a supporting member supporting the photosensitive drum is moved relative to the main assembly of the apparatus, sliding between the photosensitive drum and the transfer member can be avoided together with downsizing.

While the invention has been described with reference to the structures disclosed herein, it is not confined to the details set forth and this application is intended to cover such modifications or changes as may come within the purpose of the improvements or the scope of the following claims.

This application claims priority from Japanese Patent Applications Nos. 281048/2010 and 237521/2011 filed Dec. 16, 2010 and Oct. 28, 2011, respectively, which are hereby incorporated by reference.

What is claimed is:

1. An electrophotographic image forming apparatus for forming an image on a recording material, said apparatus comprising:

(i) a cartridge detachably mountable to a main assembly of the apparatus, said cartridge including an electrophotographic photosensitive member, a photosensitive member frame supporting said electrophotographic photosensitive member, a driving force receiving portion for receiving a driving force for driving said electrophotographic photosensitive member from said main assembly of the apparatus, and first and second portions-to-be-regulated for regulating rotation of said cartridge when said driving force receiving portion receives the driving force, said second portion-to-be-regulated being provided on said photosensitive member frame;

(ii) a transfer member for transferring a developer image formed on said electrophotographic photosensitive member onto a toner image receiving member;

(iii) a supporting member movable between an inside position which is in said main assembly of the apparatus and in which said supporting member detachably supports said cartridge and an outer position which is outside said main assembly of the apparatus and in which said cartridge is mountable and demountable;

(iv) a contacting and spacing member movable relative to said supporting member and capable of taking a first position in which said contacting and spacing member urges said second portion-to-be-regulated to space said electrophotographic photosensitive member from said transfer member and a second position in which said contacting and spacing member retracts from the first position to contact said electrophotographic photosensitive member to said transfer member;

(v) a first regulating portion for permitting, when said contacting and spacing member is in the first position, movement of said supporting member between the outer position and the inside position in a state that said first regulating portion is in engagement with said first portion-to-be-regulated to limit rotation of said cartridge; and (vi) a second regulating portion for regulating rotation of said cartridge when said contacting and spacing member is in the second position and said driving force receiving portion receives the driving force, said cartridge further including a developing roller for developing an electrostatic latent image formed on said electrophotographic photosensitive member, and a developing device frame supporting said developing roller and rotatably connected with said photosensitive member frame, wherein said first portion-to-be-regulated is provided on said developing device frame, and wherein said first regulating portion has such a configuration that when said contacting and spacing member is in the first position, said first regulating portion is engaged with said first portion-to-be-regulated, and when said contacting and spacing member is in the second position, engagement with said first portion-to-be-regulated is released.

2. An apparatus according to claim 1, wherein said contacting and spacing member includes a portion-to-be-guided for being engaged by said portion-to-be-regulated.

3. An apparatus according to claim 1, further comprising an opening, provided in said main assembly of the apparatus, for permitting insertion and removal of said supporting member relative to said main assembly of the apparatus, a door having a closing position for closing said opening and an open position for opening said opening, and an urging member, interrelated with said door, for urging said photosensitive member frame to place said contacting and spacing member in the second position when said door is in the closing position.

4. An apparatus according to claim 1, wherein said supporting member supports a plurality of such cartridges containing developers of different colors, respectively.

5. An apparatus according to claim 1, wherein said supporting member is capable of supporting a plurality of such cartridges without a partition between adjacent ones of such cartridges.

* * * * *